US008042651B1

(12) United States Patent
Michnik et al.

(10) Patent No.: US 8,042,651 B1
(45) Date of Patent: Oct. 25, 2011

(54) LADDER SUPPORT DEVICE

(76) Inventors: Alisa Michnik, Cherry Hill, NJ (US); Yefim Michnik, Cherry Hill, NJ (US)

( * ) Notice: Subject to any disclaimer, the term of this patent is extended or adjusted under 35 U.S.C. 154(b) by 0 days.

(21) Appl. No.: 12/717,614

(22) Filed: Mar. 4, 2010

(51) Int. Cl.
*E06C 1/14* (2006.01)

(52) U.S. Cl. ..... 182/107; 182/108; 182/109; 182/200

(58) Field of Classification Search ..... 182/105, 182/107, 108, 109, 110, 111, 200; 248/188.8; 108/147; 116/110.1, 114.1, 410, 430, 436, 116/442
See application file for complete search history.

(56) References Cited

U.S. PATENT DOCUMENTS

| | | | | | |
|---|---|---|---|---|---|
| 973,509 | A | * | 10/1910 | Ison | 182/200 |
| 1,088,167 | A | * | 2/1914 | Osterhoudt | 182/200 |
| 1,424,934 | A | * | 8/1922 | Paterson et al. | 182/200 |
| 2,503,626 | A | * | 4/1950 | Mayberry | 182/201 |
| 2,971,602 | A | * | 2/1961 | West | 182/200 |
| 3,363,725 | A | * | 1/1968 | Lorrance | 188/2 R |
| 4,324,477 | A | * | 4/1982 | Miyazaki | 248/163.1 |
| 4,457,397 | A | * | 7/1984 | Scala | 182/116 |
| 4,699,247 | A | * | 10/1987 | Clarke | 182/107 |
| 4,896,745 | A | * | 1/1990 | Warnelov | 182/200 |
| 4,993,514 | A | * | 2/1991 | Ferguson | 182/200 |
| 5,078,231 | A | * | 1/1992 | Davis | 182/107 |
| 5,417,302 | A | * | 5/1995 | McElfresh | 182/108 |
| 5,464,071 | A | * | 11/1995 | Rice et al. | 182/205 |
| 5,507,364 | A | * | 4/1996 | Spevak | 182/200 |
| 5,704,451 | A | * | 1/1998 | King | 182/204 |
| 5,816,364 | A | * | 10/1998 | Christy et al. | 182/201 |
| 6,044,929 | A | | 4/2000 | Wishner | |
| 6,053,284 | A | * | 4/2000 | Fountain | 182/180.2 |
| 6,179,087 | B1 | * | 1/2001 | Moffat | 182/15 |
| 6,336,521 | B1 | * | 1/2002 | Dennis | 182/200 |
| 6,378,656 | B1 | * | 4/2002 | Kohler | 182/200 |
| 6,688,426 | B1 | * | 2/2004 | Mikros | 182/17 |
| 2008/0078616 | A1 | | 4/2008 | Ursitti | |

FOREIGN PATENT DOCUMENTS

| | | | |
|---|---|---|---|
| JP | 2005061033 | A | 8/2003 |

* cited by examiner

*Primary Examiner* — Katherine Mitchell
*Assistant Examiner* — Colleen M Quinn

(57) ABSTRACT

A portable leveling device capable of supporting any types of ladders, scaffolds, and other objects requiring leveled support regardless of object size when a plurality of the devices is used. The device may be deployed by one hand automatically and instantly quick over a terrain of virtually any profile. The device is capable of projecting an extension ladder position eliminating human error and reducing deployment time when the ladder is actually positioned. The device is capable of indicating deployment faults before use and allows visual inspection of the parts at fault without disassembling. The device is lightweight, can be easily carried with one hand, and stored compactly.

14 Claims, 45 Drawing Sheets

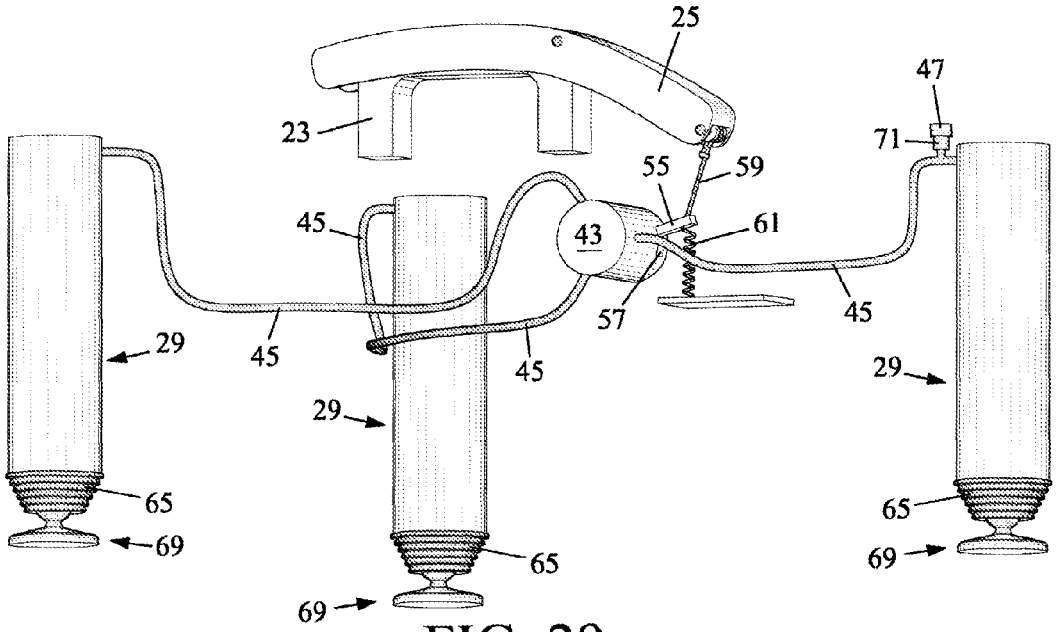
FIG. 29
FIG. 30
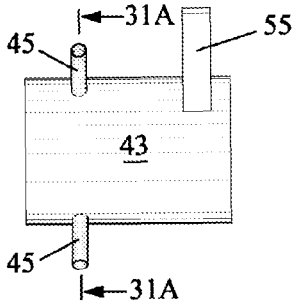
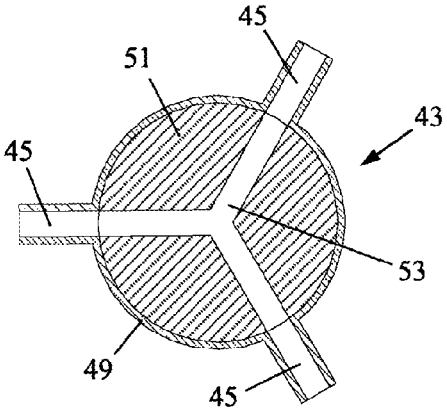
FIG. 31A
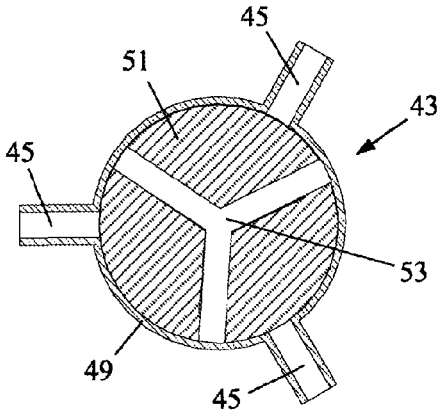
FIG. 31B

LADDER SUPPORT DEVICE

BACKGROUND OF THE INVENTION

1. Field of the Invention

The present invention relates generally to ladder leveling platforms where, specifically, an ability for instantly quick deployment regardless of ground profile is required.

2. Background of the Invention

The present invention is a ladder support device which can be leveled and which can be deployed on a solid surface of virtually any type and profile instantly quick and, metaphorically speaking, with a push of a button.

Numerous embodiments of ladders with integrated leveling means are found in the art. For example, U.S. Pat. Application No. 20080078616 filed on Apr. 3, 2008 by Ursitti discloses a self leveling ladder system which comprises a ladder with a hydraulic leveling system and Japanese Patent Application No. JP2005061033(A) filed on Aug. 12, 2003 by Tatsuya Kenji discloses a leg length adjusting device for trestle comprising a stepladder with adjustable legs. However, integrated leveling means add weight to the ladder making it more difficult to carry it between locations, can not be reused with different ladders multiplying costs by each additional ladder, occupy extra storage space multiplied by each additional ladder; if the ladder is stored overhead, additional weight may require more than one person for handling; one should also consider extra weight since storing overhead creates an ideal arm position for tearing a bicep muscle (arms raised and bent at about 120 degrees); back problem is also probable. In addition, adjusting relatively heavy and/or large ladder may take too much time and tire a user, especially if user is a contractor readjusting the ladder often.

Despite that numerous ladder support platforms have been provided in prior art, none can deployed instantly quick. For example, U.S. Pat. No. 6,044,929 issued on Apr. 4, 2000 to Wishner, discloses a ladder leveling platform comprising a frame and adjustable legs. However, Wishner's ladder leveling platform has the following limitation: the adjustment of legs is not simultaneous and, therefore, is time consuming.

Consequently, there is a need for a ladder leveling platform which can automatically adjust to ground of any type and profile instantly quick.

OBJECTS OF THE INVENTION

Accordingly, several objects and advantages of the present invention are:

To provide a time saving ladder support device which can be deployed instantly quick.

To provide a reliable ladder support device by using a small number of simple mechanical parts.

To provide a cost efficient ladder support device by using off-the-shelf parts.

To provide a safe ladder support device which can be easily visually inspected before every use.

To provide a convenient ladder support device which automatically adjusts to ground of virtually any type and profile by using a single release mechanism.

To provide a functional ladder support device which can be used inside and outside of dwellings.

To provide an adaptable ladder support device deployable on a solid surface of any type while preserving integrity of the surface.

To provide even more convenient ladder support device which can be positioned on the ground with or without a ladder.

To provide an accommodating ladder support device which allows a user to carry and to position the ladder support device with the ladder on top.

To provide an efficient ladder support device which can be leveled automatically without use of an inclinometer.

To provide a time efficient ladder support device which, when deployed without a ladder, allows to anticipate the position of the top portion of a ladder, thereby reducing time required for repositioning.

To provide a space efficient ladder support device which can be stored with or without a ladder.

To provide a practical ladder support device which can be used by a single person.

To provide an easy to maintain ladder support device which is waterproof for easy cleaning using a garden hose.

To provide an even more adaptable ladder support device which accommodates different size ladders.

To provide a multi-functional ladder support device which can support an object other than a ladder.

To provide an even more multi-functional ladder support device, a plurality of which can support any kind of a ladder: extension ladders, step-ladders, scaffolds, etc.

To provide yet more versatile multi-functional ladder support device, a plurality of which can simultaneously support an object other than a ladder.

Further objects and advantages of this invention will become apparent from a consideration of the drawings and ensuing description.

SUMMARY OF THE INVENTION

A ladder support device of the present invention comprises a ladder supporting platform and support elements which hold the ladder supporting platform above the ground when the ladder support device is deployed. All of the supporting elements of the ladder support device are adjusted simultaneously when released by a release mechanism for instantly quick deployment of the leveled ladder supporting platform over a solid surface of virtually any type and profile.

The features briefly described in this summary as well as other features and advantages of this invention will become apparent to those skilled in the art upon review of the following drawings, the detailed description, and the appended claims.

BRIEF DESCRIPTION OF THE DRAWINGS

FIG. 28 is a front view of the ladder support device depicted in FIG. 27 shown with the hydraulic valve turned on;

FIG. 29 is a perspective view of the release lever, handle, hydraulic cylinders, hydraulic valve, and hydraulic pressure tubes of the ladder support device depicted in FIG. 28;

FIG. 30 is a partial side view of hydraulic pressure tubes connected to a hydraulic valve with a lever;

FIG. 31A is a sectional view taken along line 31A-31A of the embodiment depicted in FIG. 30 with the hydraulic valve turned on;

FIG. 31B is the same view as depicted in FIG. 31A but with the hydraulic valve turned off;

DETAILED DESCRIPTION OF THE INVENTION

Figure 1A:
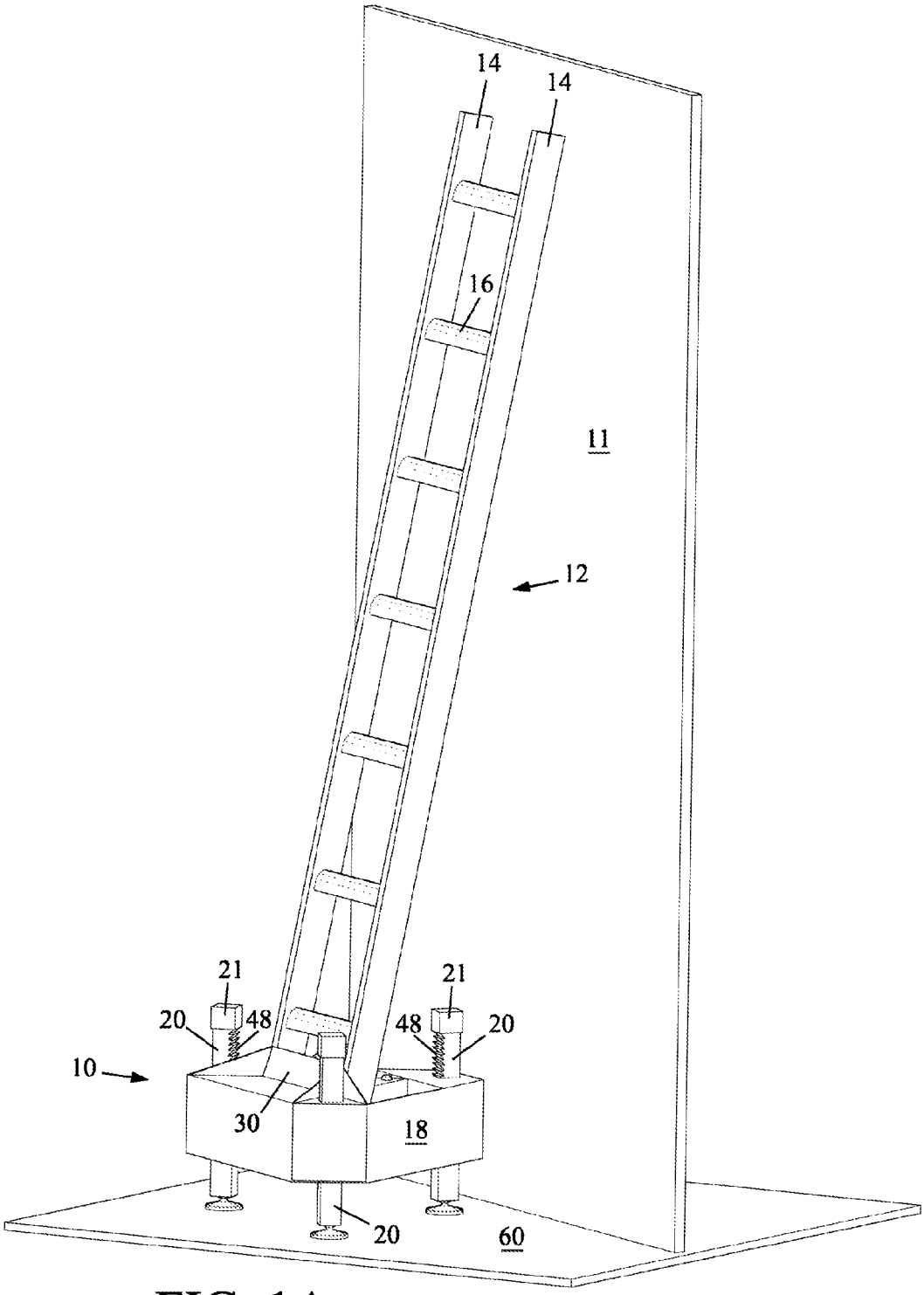
FIG. 1A is a perspective view of a ladder standing on a ladder support device comprising three support elements.

FIGS. 1A-23 depict a sample embodiment of a ladder support device 10. Ladder support device 10 (FIG. 1A) is used with a ladder 12 having spaced side rails 14 connected by spaced rungs 16; ladder 12 is leaned on wall 11. Ladder support device 10 comprises a support platform 18 and three support elements 20. Each of support elements 20 is longitudinal and comprises a cap 21 at the top and teeth 48 along the longitudinal dimension. For demonstrative purposes, each of support elements 20 is depicted as a square bar, although other shapes are acceptable.

Figure 4:
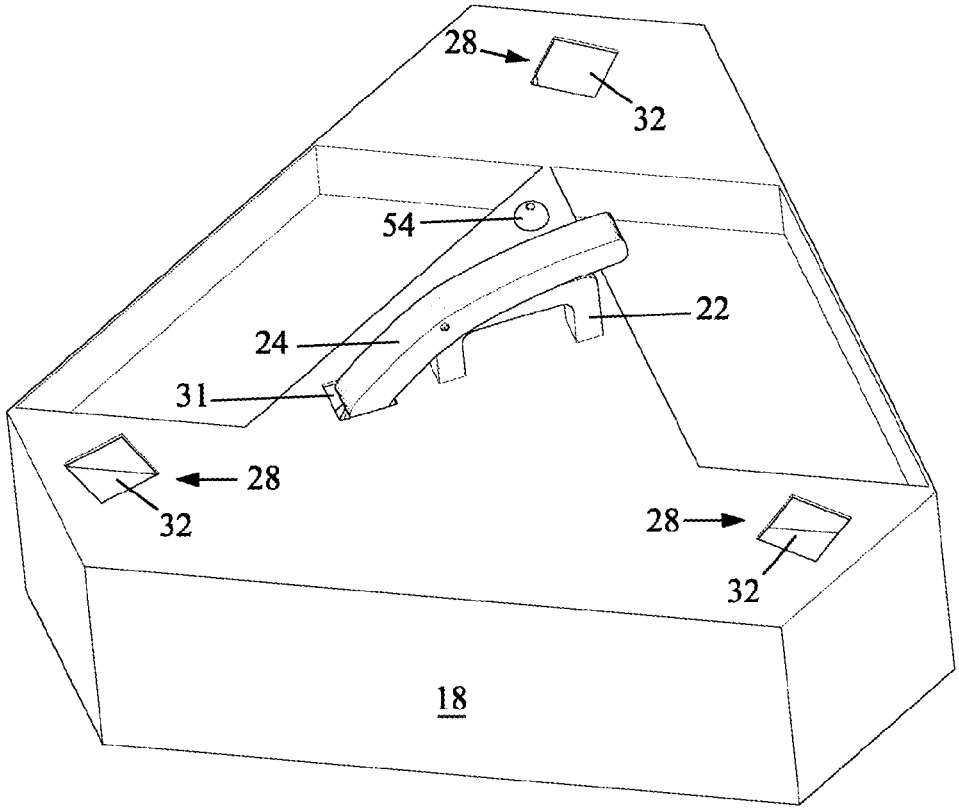
FIGS. 4 and 5 are perspective views of the support platform of the ladder support device depicted in FIG. 3 without the support elements.
Figure 5:
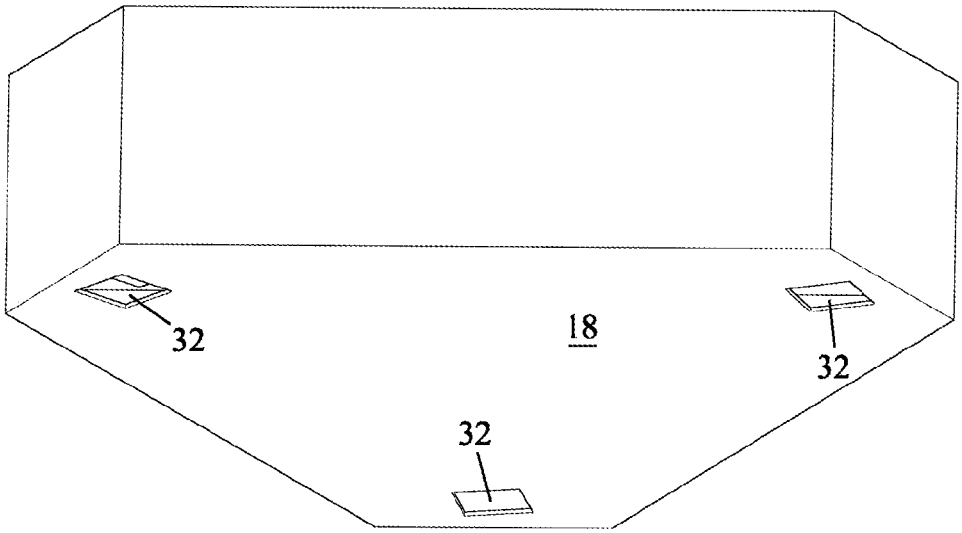
Figure 6:
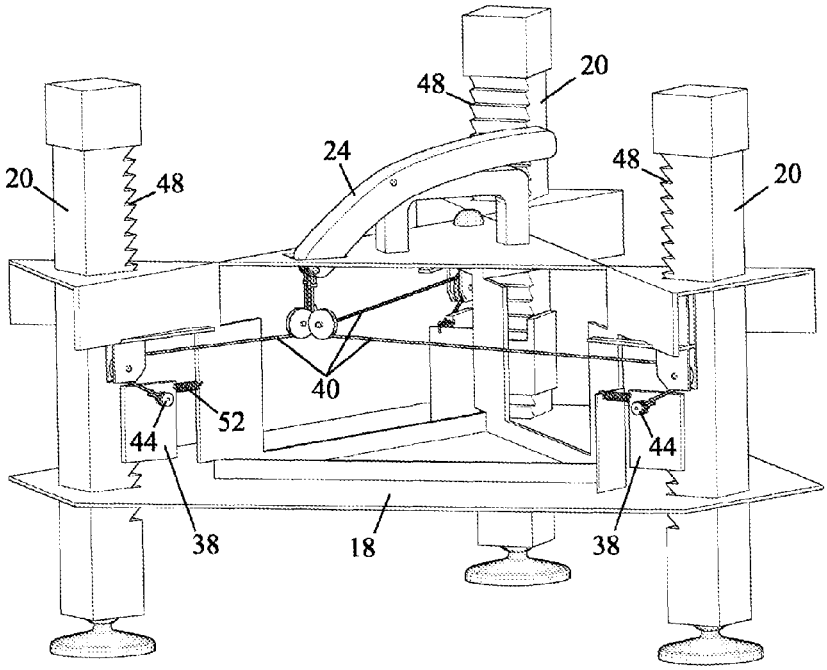
FIG. 6 is a perspective view of the ladder support device depicted in FIG. 3 with the support platform shown without some of the walls and ribs for clarity.
Figure 7:
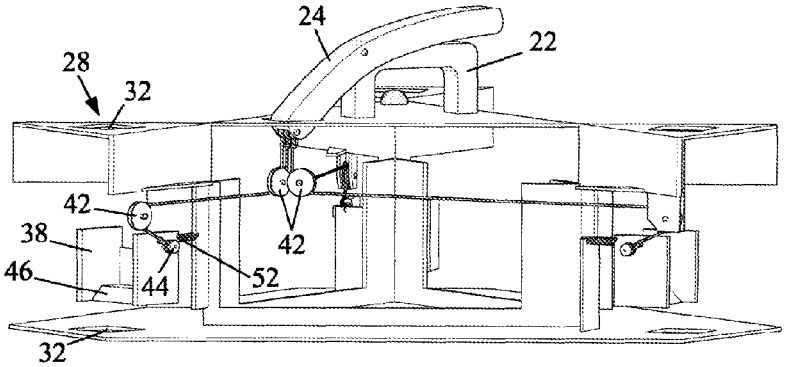
FIG. 7 is a perspective view of the support platform depicted in FIG. 6 demonstrating a latch with one tooth.
Figure 8:
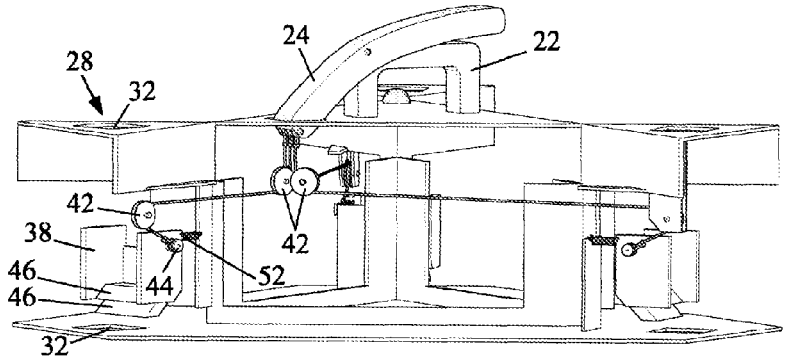
FIG. 8 is a perspective view of the support platform depicted in FIG. 6 demonstrating a latch with two teeth.
Figure 9:
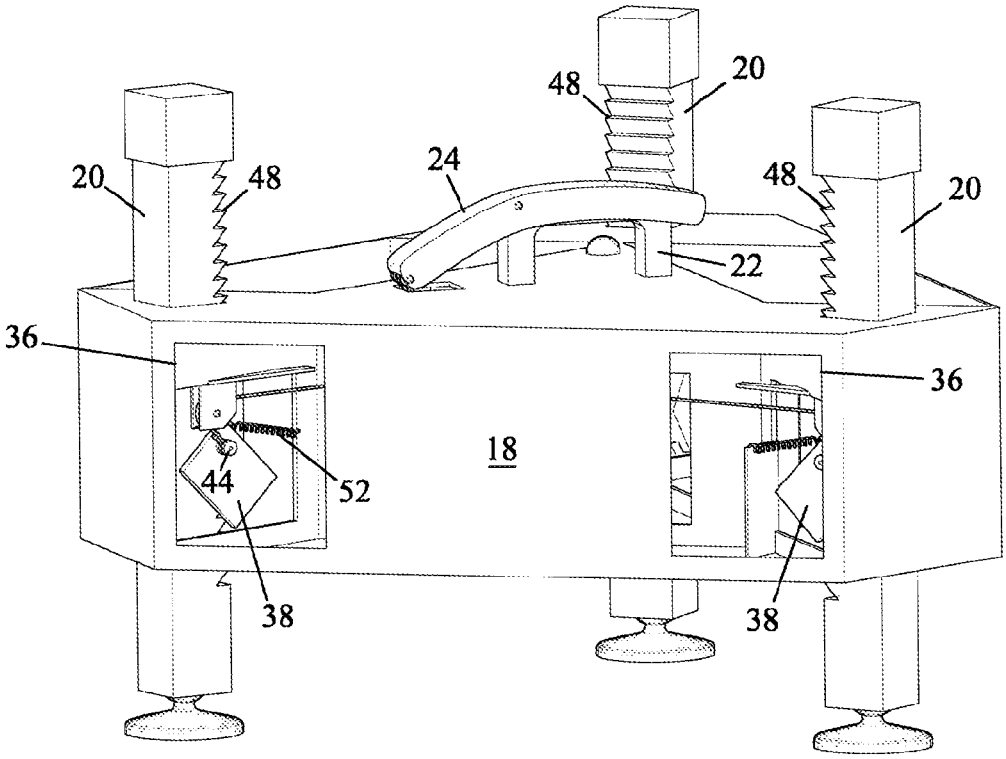
FIG. 9 is a perspective view of a ladder support device comprising transparent plates and shown in a position where the latch teeth are disengaged from the support element teeth.
Figure 10:
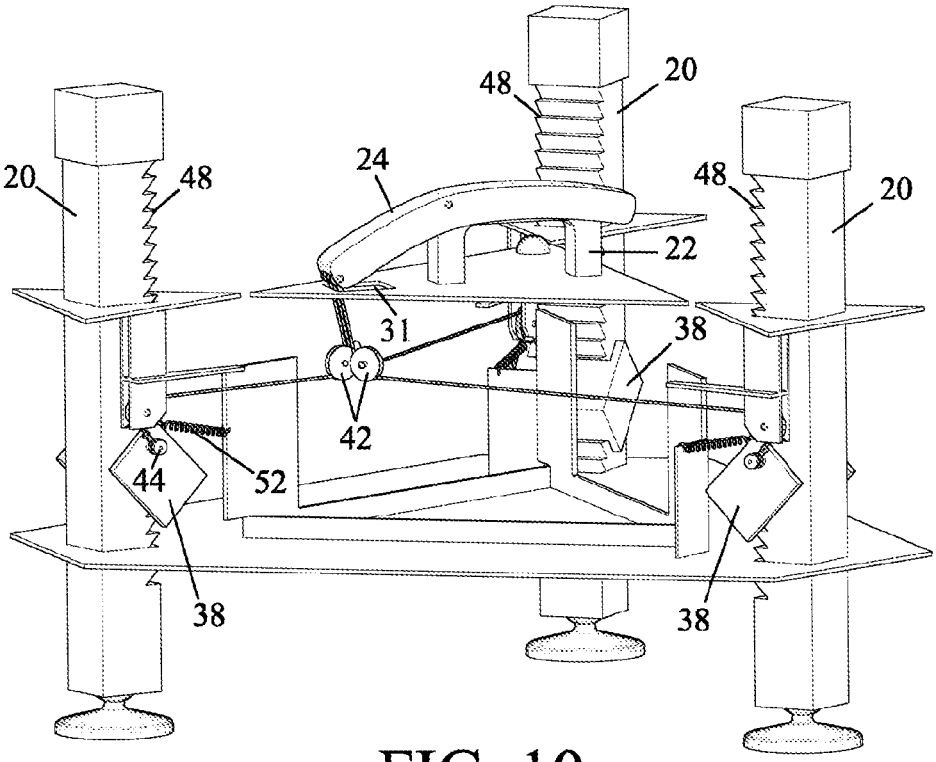
FIG. 10 is a perspective view of the ladder support device depicted in FIG. 9 without some of the walls and ribs for clarity.
Figure 11A:
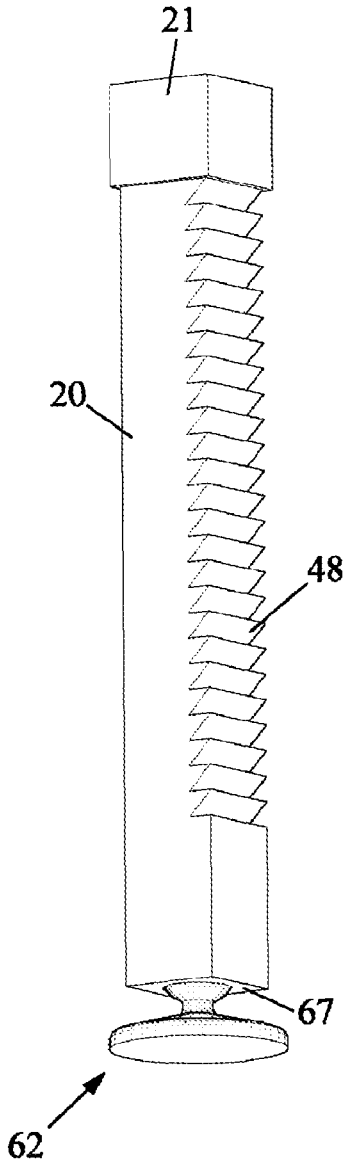
FIG. 11A is a perspective view of a support element comprising a non-detachable shoe.
Figure 11B:
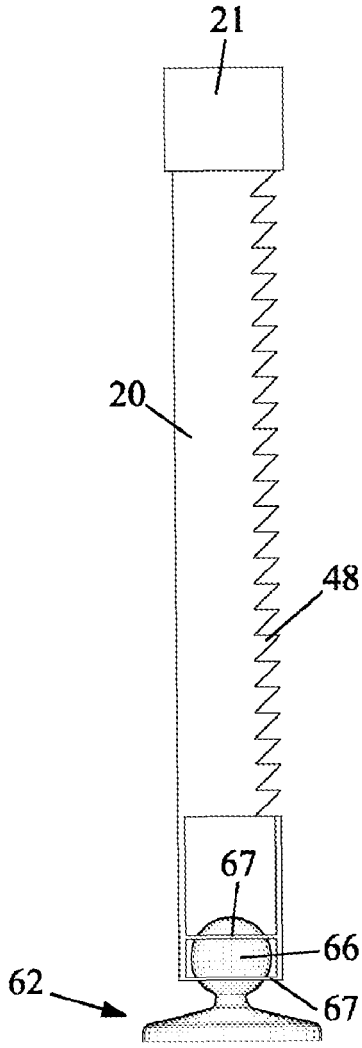
FIG. 11B is a front view of the support element depicted in FIG. 11A shown without a portion of the wall for clarity.

Support platform 18 comprises handle 22 (FIG. 3) fixed to its upward side, a release lever 24, a work area 26 (best seen in FIG. 2), and three guides 28 (FIG. 4). Although, for demonstrative purposes, support platform 18 is chosen to be triangular, it can be circular, square, or have any other shape; and the number of support elements 20 and guides 28 can be more than three, if desired.

Work area 26 is a ladder-supporting area incorporating vertical stopping elements 30 (FIG. 2) limiting the horizontal movement of a ladder lower end on the ladder-supporting area.

Each of the guides 28 comprises a latch 38 (FIG. 7) and two openings 32 in the upward and bottomward sides of support platform 18 for directing movement of one of support elements 20 (FIG. 6) perpendicularly to the upward side. Latch 38 comprises a tension spring 52 and one tooth 46 (FIG. 7) or two teeth (FIG. 8), although more teeth can be used if desired. Tension spring 52 is connected with one end to support platform 18 and with the other end to latch 38 (see also FIGS. 1B-1E and 6). Latch 38 is pivotally connected to support platform 18 with an axis 44.

Figure 18:
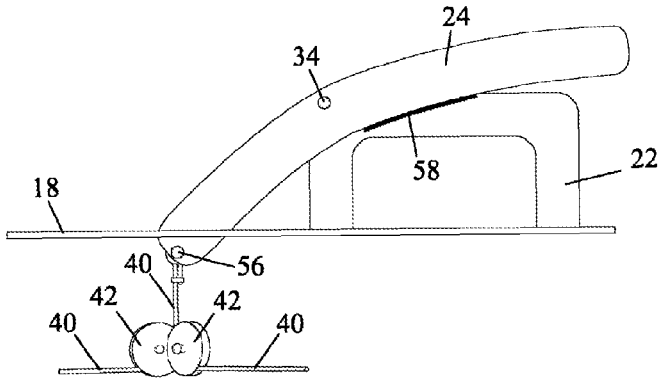
FIG. 18 is a partial front view of the support platform with the release lever shown in a position where markings located on the handle are exposed.
Figure 19:
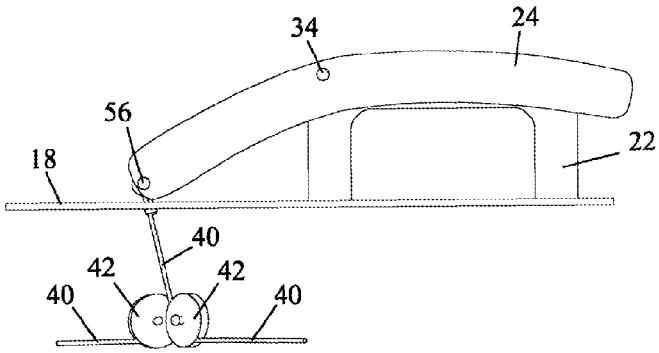
FIG. 19 is a partial front view of the support platform with the release lever shown in a position where markings located on the handle are hidden.
Figure 20:
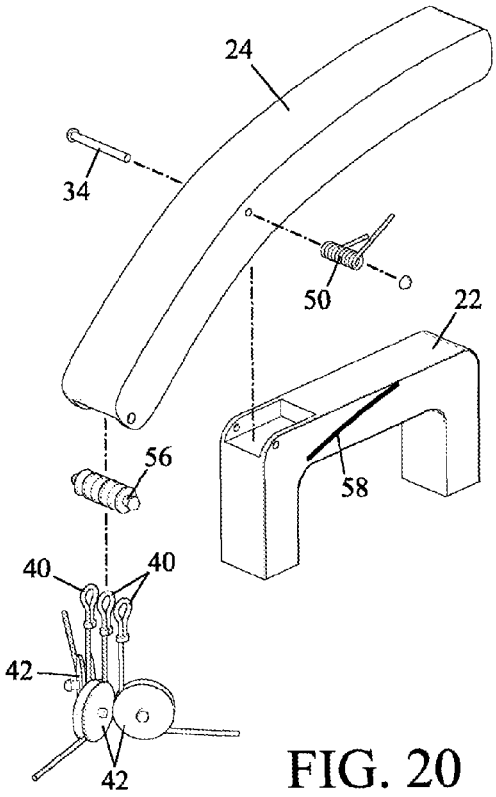
FIG. 20 is an exploded perspective view of the handle and release lever assembly depicted in FIG. 18.

Release lever 24 is pivotally connected to handle 22 with an axis 34 (best seen in FIGS. 18-20). One end of release lever 24 is kept above handle 22 (FIG. 18) by a torsion spring 50 (FIG. 20). Another end of release lever 24 is connected to all latches 38 (FIGS. 6-8) with cables 40 routed through an opening 31 (FIGS. 4 and 10) of support platform 18 using pulleys 42. Cables 40 are attached to an axis 56 (FIGS. 18-20) of release lever 24 with one end and to latches 38 with the other end. Each of the pulleys 42 is installed between ribs of support platform 18 (the ribs are not shown for clarity).

Tension springs 52, when not pulled, keep teeth 46 of latches 38 engaged with teeth 48 of support elements 20 preventing movement of support platform 18 about support elements 20 standing on solid surface 60 due to a force of gravity (depicted as force F in FIGS. 1B and 1D) applied to support platform 18.

Figure 16:
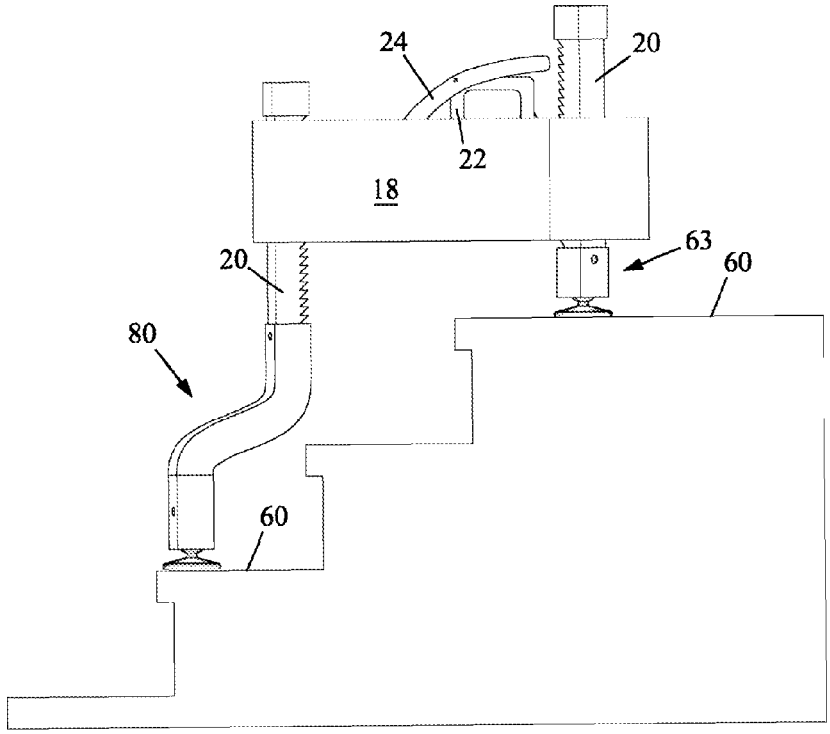
FIG. 16 is a side view of a ladder support device positioned on steps.
Figure 17:
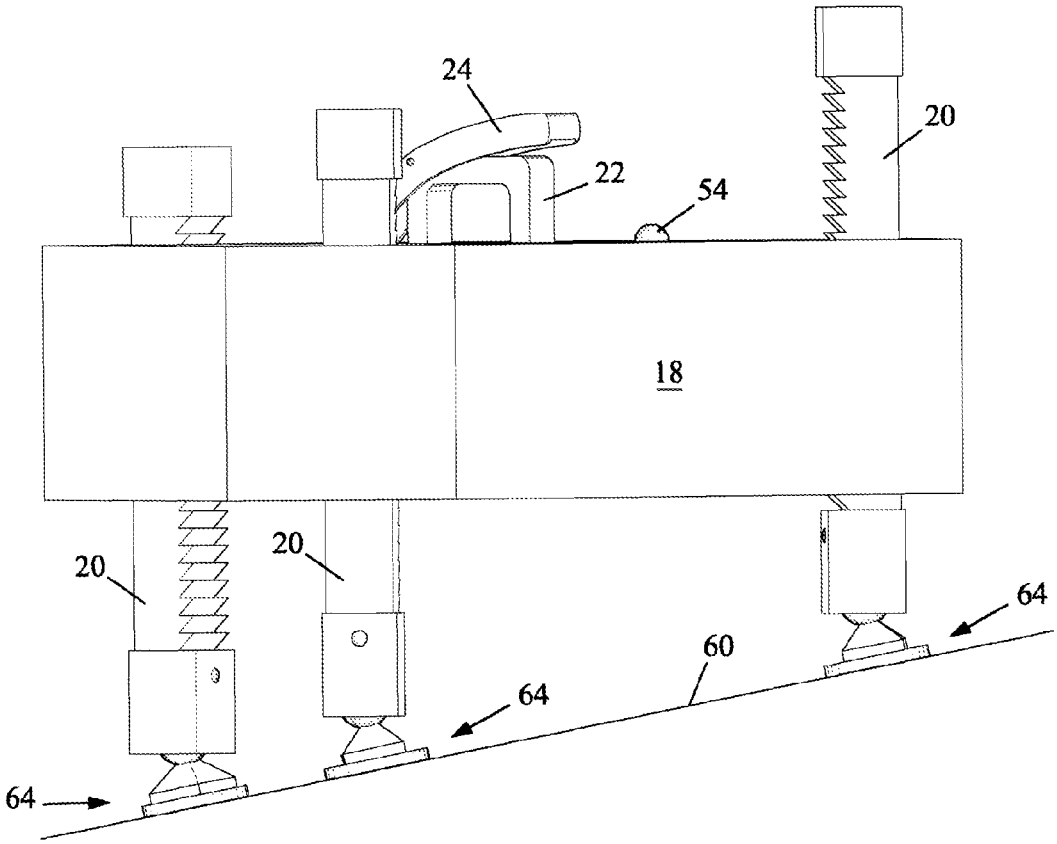
FIG. 17 is a side view of a ladder support device leveled on an inclined surface.

In use, a user positions support platform 18 above solid surface 60 at a desired location using handle 22 and levels it horizontally using reading of an inclinometer 54 (FIG. 2); then the user squeezes upper end of release lever 24 toward handle 22 (FIGS. 9, 10, and 19); as a result, lever 24 is pivoted about axis 34 tensioning torsion spring 50 and pulling all cables 40 simultaneously which, in turn, pull all tension springs 52 causing pivotal movement of latches 38 about axes 44 and disengagement of all teeth 46 from teeth 48 (FIGS. 1C, 1E, 9, and 10); since support elements 20 are no longer fixated to support platform 18 with teeth 46, support elements 20 move simultaneously toward solid surface 60 under force of gravity; when all of support elements 20 meet solid surface 60, the user stops squeezing release lever 24; as a result, release lever 24 is pivoted by decompression force of torsion spring 50 releasing all cables 40 and allowing the release force of springs 52 to pivot latches 38 about axes 44 until all teeth 46 engage with teeth 48 fixating the position of leveled by the user support platform 18 about solid surface 60, regardless of the profile of solid surface 60 (FIGS. 16 and 17). If any tooth 46 is not engaged right away with teeth 48, tension spring 52 is not fully released keeping torsion spring 50 from being released by cable 40 and resulting in partial return of release lever 24 hiding markings 58 (FIG. 19) from being seen by the user; hidden markings 58 indicate to the user that the ladder support device is not ready; unrealized force of tension spring 52 will engage tooth 46 (FIG. 1D, or teeth 46 in FIG. 8) with teeth 48 as soon as the support element 20 is moved slightly about support platform 18, for instance, when the user pushes support platform 18 toward solid surface 60 until markings 58 become visible (FIG. 18) indicating to the user that the ladder support device is ready (deployed). Support elements 20, due to their relative arrangement, provide a means for supporting orientation of the deployed ladder support device 10 when unattended. Markings 58 are located on both sides of handle 22 (only one marking 58 is visible in FIGS. 18 and 20). If pushing support platform 18 toward solid surface 60 does not make the ladder support device ready, the user is able to examine the guides 28 through transparent plates 36 for the reason (an embodiment of support platform 18 with transparent plates 36 is shown only in FIG. 9).

Support platform 18 must be positioned by a user close enough to solid surface 60 for all of support elements 20 to reach solid surface 60 when release lever 24 is squeezed. After support platform 18 stands on solid surface 60, the user is able to readjust height and orientation of support platform 18 when squeezing release lever 24.

When a user wants to reposition support platform 18, the user removes ladder 12 and carries support platform 18 to a new location using handle 22. As an option, the user is able to squeeze release lever 24 and move support platform 18 toward solid surface 60 resetting position of support elements 20 about support platform 18 simultaneously before carrying support platform 18 to a new location.

Since each of support elements 20 is moving independently toward solid surface 60 when release lever 24 is squeezed, the support platform 18 can be leveled above even or uneven solid surface 60 (FIGS. 16 and 17).

Figure 2:
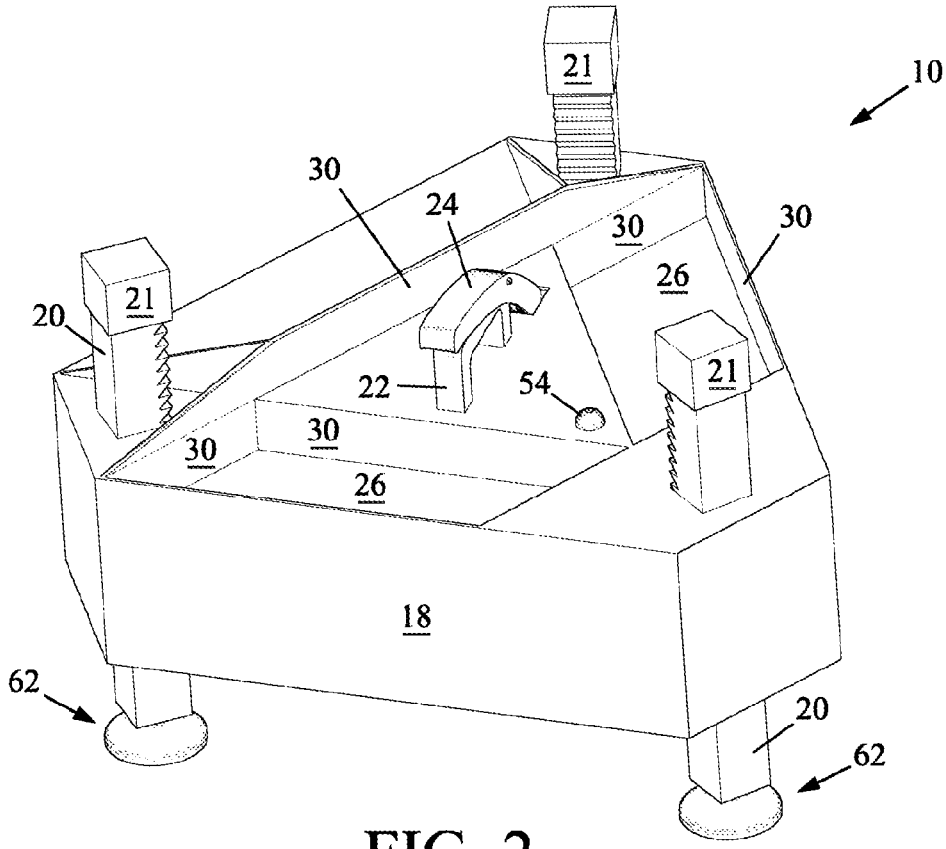
FIG. 2 is a perspective view of the ladder support device depicted in FIG. 1A without a ladder.
Figure 3:
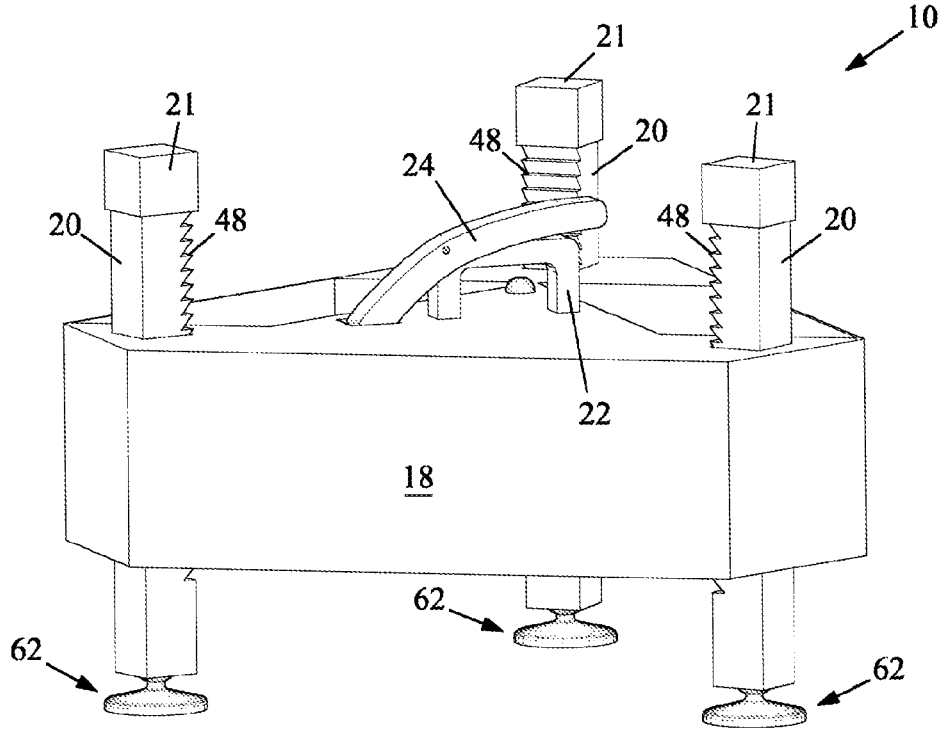
FIG. 3 is a perspective view of the ladder support device depicted in FIG. 2 shown without a vertical stopping element for clarity.

Support platform 18 accommodates ladders with the distance between side rails 14 falling within a predetermined range limited by vertical stopping elements 30 (FIG. 2).

Figure 12A:
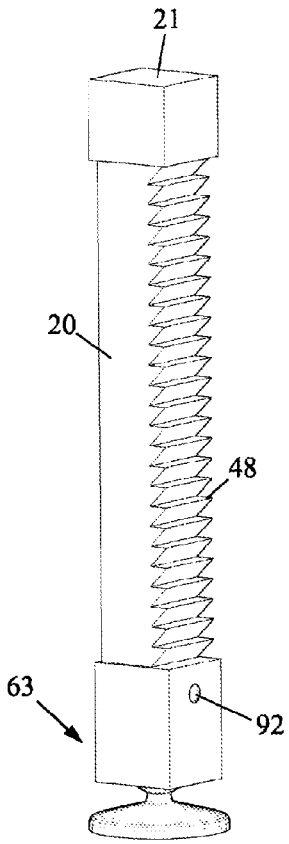
FIG. 12A is a perspective view of a support element comprising a detachable shoe.
Figure 12B:
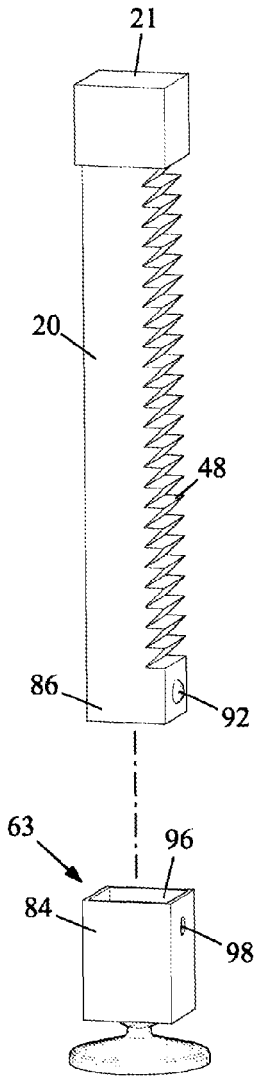
FIG. 12B is an exploded view of the support element depicted in FIG. 12A.
Figure 12C:
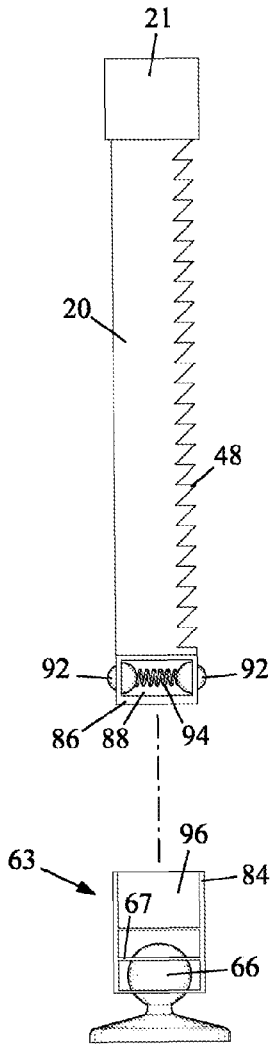
FIG. 12C is an exploded front view of the support element depicted in FIG. 12A shown without portions of the walls for clarity.

In order to improve stability of ladder support device 10 and preserve integrity of solid surface 60, each of support elements 20 comprises a non-detachable shoe 62 (FIGS. 11A and 11B) or a detachable shoe 63 (FIGS. 12A-12C). Shoe 62 is flexibly installed by a ball joint 66 secured between ribs 67 at the bottom end of support element 20 to provide support at any orientation of shoe 62 about solid surface 60.

Detachable shoe 63 comprises a female assembly 84 at the top. Female assembly 84 is adapted to engage with a male assembly 86 installed at the bottom of support element 20. Male assembly 86 comprises hollow section 88 and two balls 92 kept apart by compression spring 94 within hollow section 88 (FIG. 12C). Female assembly 84 comprises two opposing circular opening 98 (only one is seen in FIG. 12B) and a hollow section 96. When detachable shoe 63 is snapped onto support element 20, hollow section 96 slides over male assembly 86 causing balls 92 to go inside of hollow section 88 by compressing spring 94 until openings 98 are aligned with balls 92. Decompression force of spring 94 forces balls 92 out of hollow section 88 and inside of openings 98 when openings 98 are aligned with balls 92. Decompression force of spring 94 is enough to keep male assembly 86 attached to female assembly 84 despite force of gravity. A user detaches shoe 63 from support element 20, for instance, by squeezing balls 92 and pulling female assembly 84 from male assembly 86 or by just pulling female assembly 84 from male assembly 86 with a force larger than force of gravity.

Figure 13A:
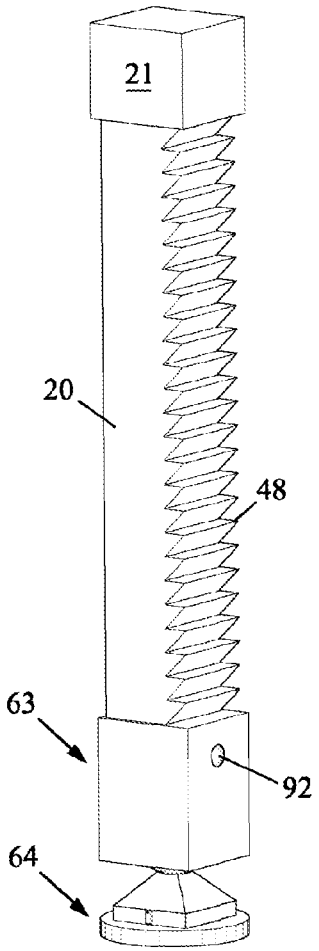
FIG. 13A is a perspective view of a support element comprising a detachable shoe and a detachable sole.
Figure 13B:
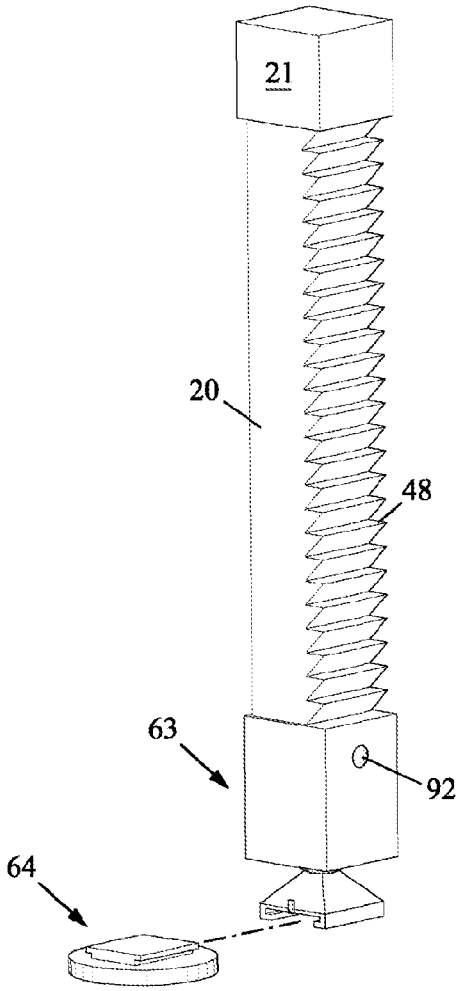
FIG. 13B is an exploded view of the support element depicted in FIG. 13A.
Figure 13C:
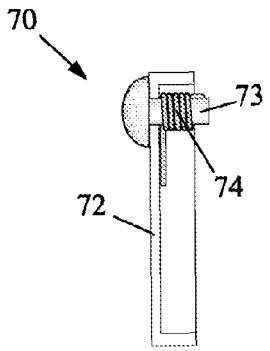
FIG. 13C is a side view of the latch of the support element depicted in FIG. 13A.
Figure 13D:
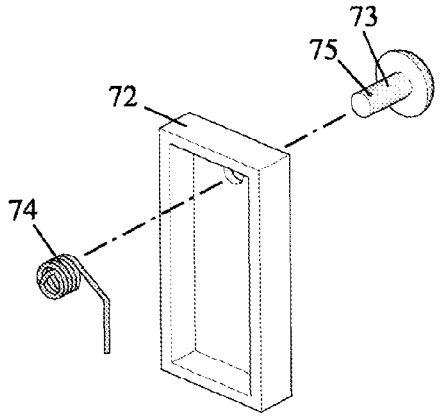
FIG. 13D is an exploded perspective view of the latch depicted in FIG. 13C.
Figure 13E:
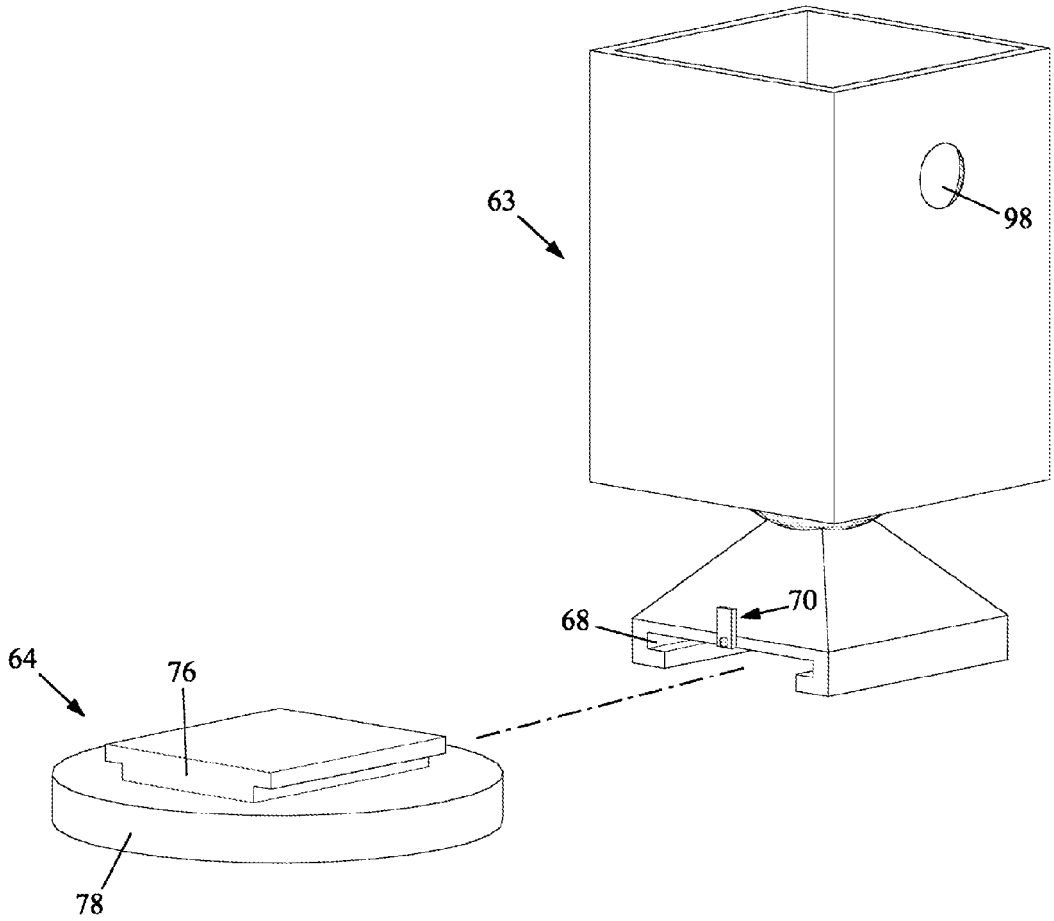
FIG. 13E is an enlarged exploded view of the detachable shoe and the detachable sole depicted in FIG. 13B.

Either shoe 62 or detachable shoe 63 may comprise a detachable sole 64. For demonstrative purposes FIGS. 13A, 13B, and 13E depict detachable shoe 63 with a detachable sole 64. Detachable shoe 63 comprises a slot 68 and a latch 70 comprising a lever 72 pivotal about an axis 73 and a torsion spring 74 (FIGS. 13A-13E). One end of torsion spring 74 is positioned in a hole 75 of axis 73 and the other end is positioned against inner wall of lever 72. Detachable sole 64 comprises contact surface 78 adapted for a specific solid surface 60 and a profiled member 76 adapted to slide inside of slot 68 (FIG. 13E).

In use, a user pivots lever 72 compressing torsion spring 74 to fully expose slot 68; then the user slides profiled member 76 of detachable sole 64 inside of slot 68 and releases lever 72; decompression force of torsion spring 74 pivots back lever 72 preventing sole 64 from falling off detachable shoe 63. Lever 72 is pivoted by a user again when sole 64 shall be removed or replaced (FIG. 13E).

Figure 14A:
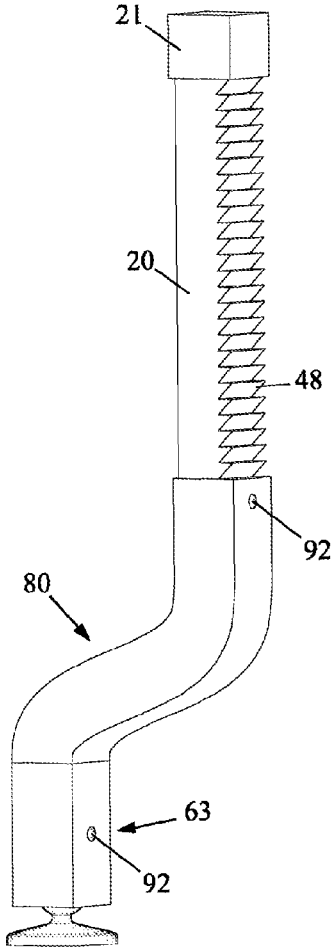
FIG. 14A is a perspective view of a support element comprising a detachable shoe and an expander.
Figure 14B:
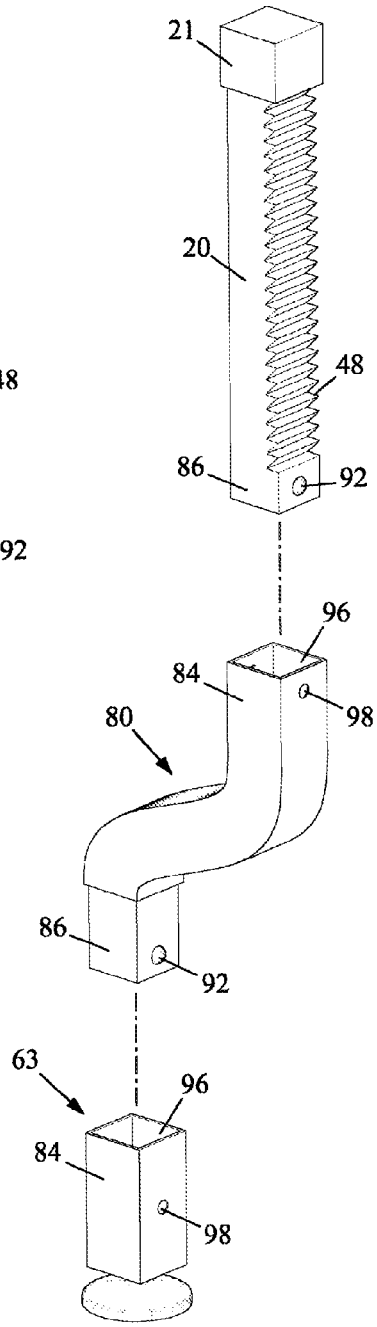
FIG. 14B is an exploded view of the support element depicted in FIG. 14A.
Figure 14C:
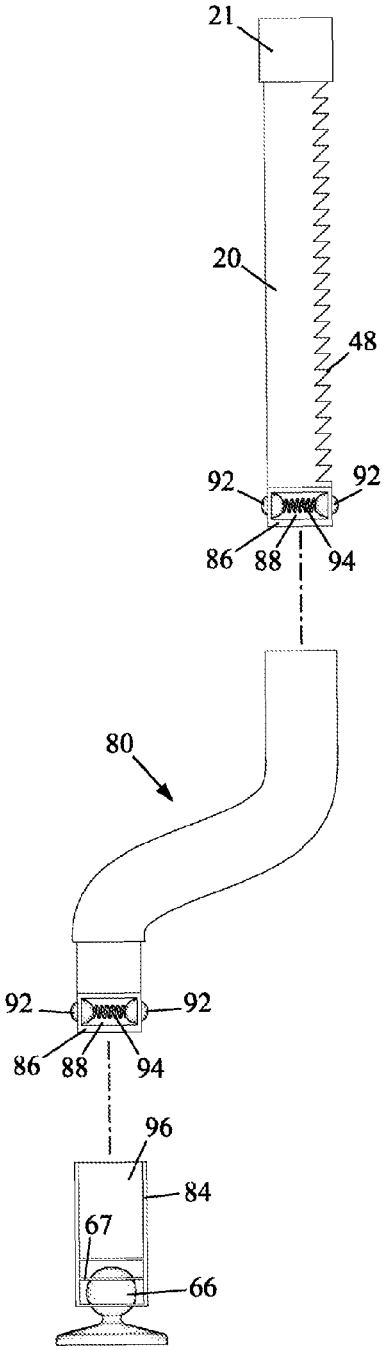
FIG. 14C is an exploded front view of the support element depicted in FIG. 14A shown without portions of the walls for clarity.
Figure 15:
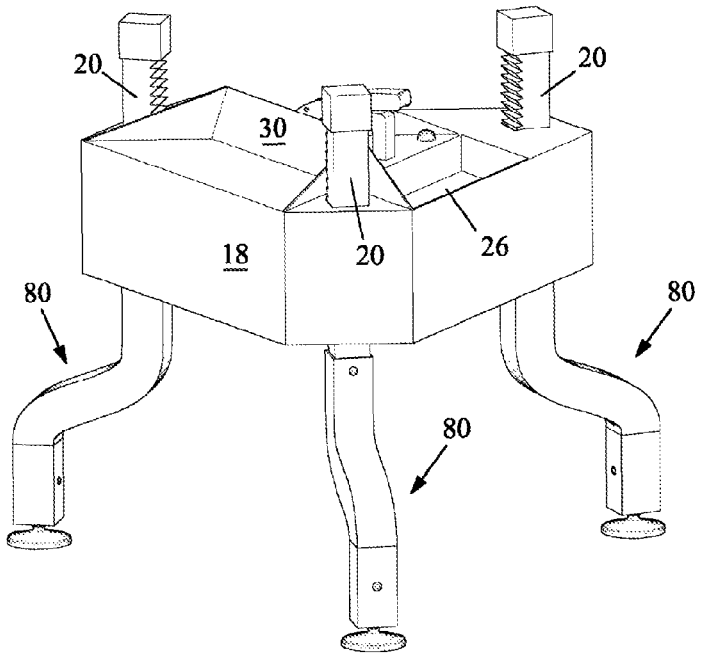
FIG. 15 is a perspective view of a ladder support device comprising three expanders.

It might be necessary to increase height and/or footprint of support platform 18 using expanders 80 attachable between support elements 20 and shoes 63 (FIGS. 14A-14C). Shape of expanders 80 depicted in FIGS. 14A-16 is chosen for demonstrative purposes only; other shapes may be used, if desired. Top end of expander 80 comprises a female assembly 84. Bottom end of support element 20 comprises male assembly 86. Bottom end of expander 80 also comprises male assembly 86. Attaching and detaching elements using assemblies 84 and 86 is described in paragraph [0127].

Figure 21:
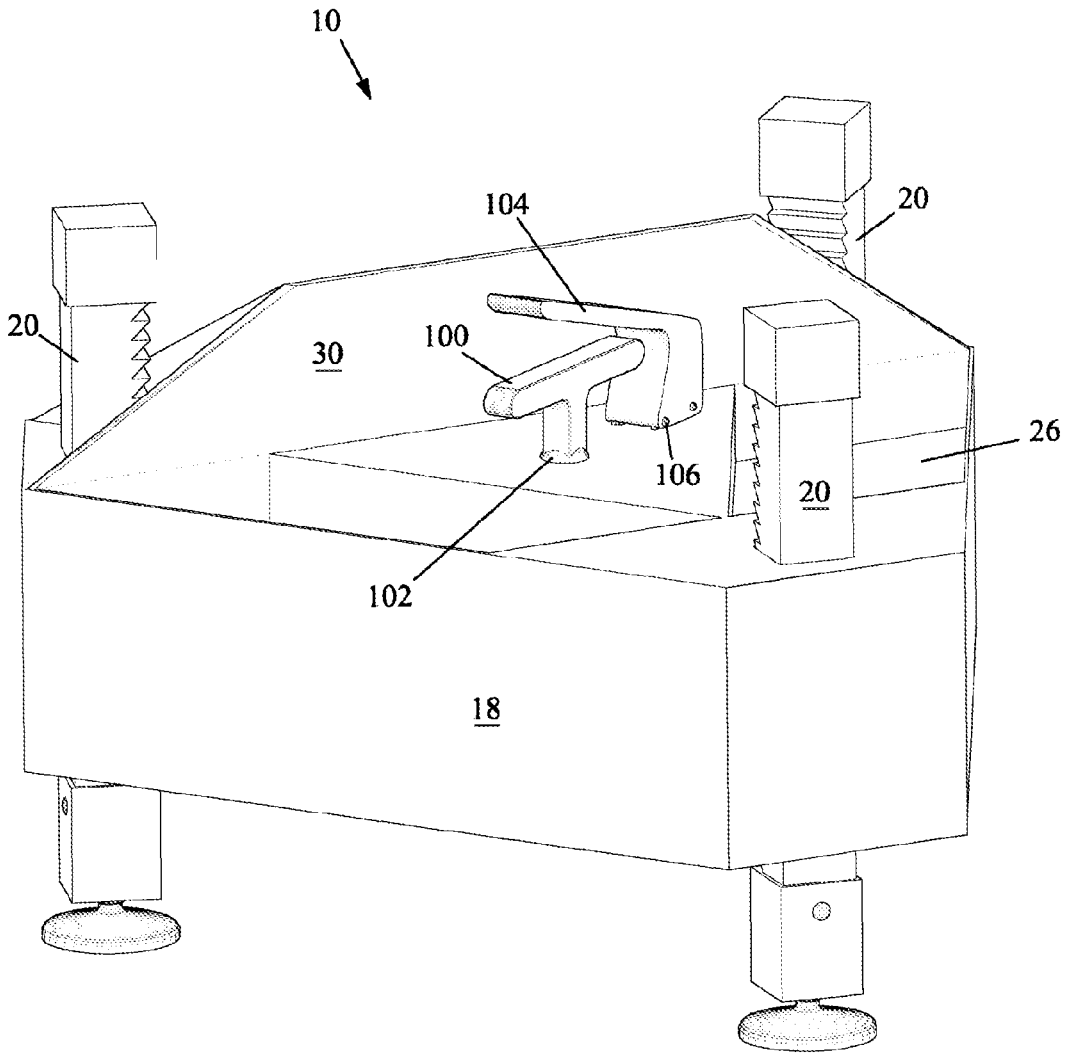
FIG. 21 is a perspective view of a ladder support device comprising a flexible handle.
Figure 22:
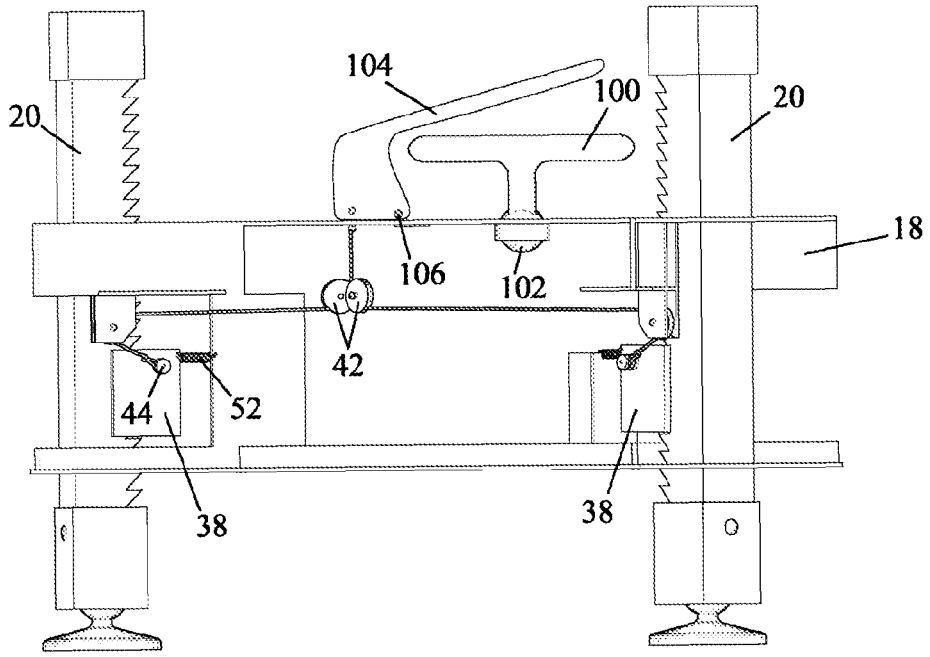
FIG. 22 is a front view of the ladder support device depicted in FIG. 21 shown without a vertical stopping element and some of the walls and ribs for clarity where the latch teeth are engaged with the support element teeth.
Figure 23:
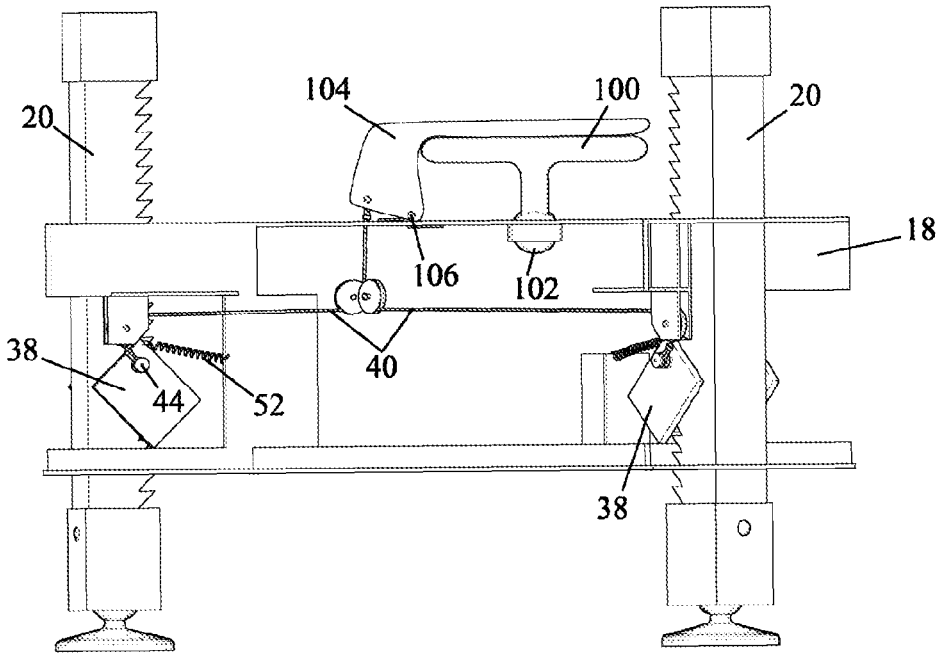
FIG. 23 is a front view of the ladder support device depicted in FIG. 22 where the latch teeth are disengaged from the support element teeth.
Figure 24:
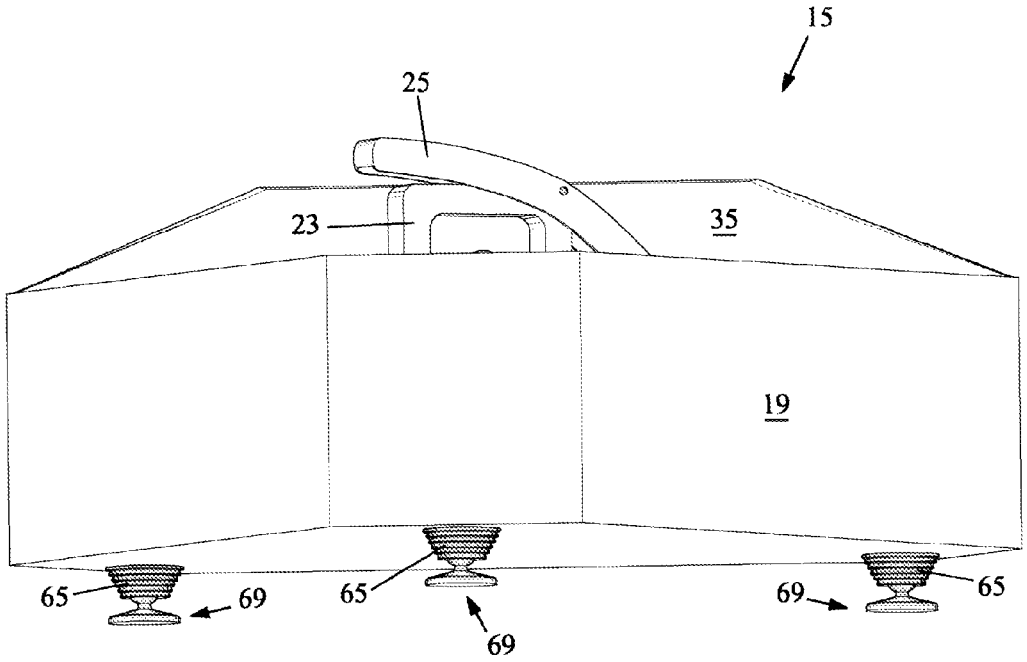
FIG. 24 is a perspective view of another embodiment of a ladder support device comprising three support elements.
Figure 25:
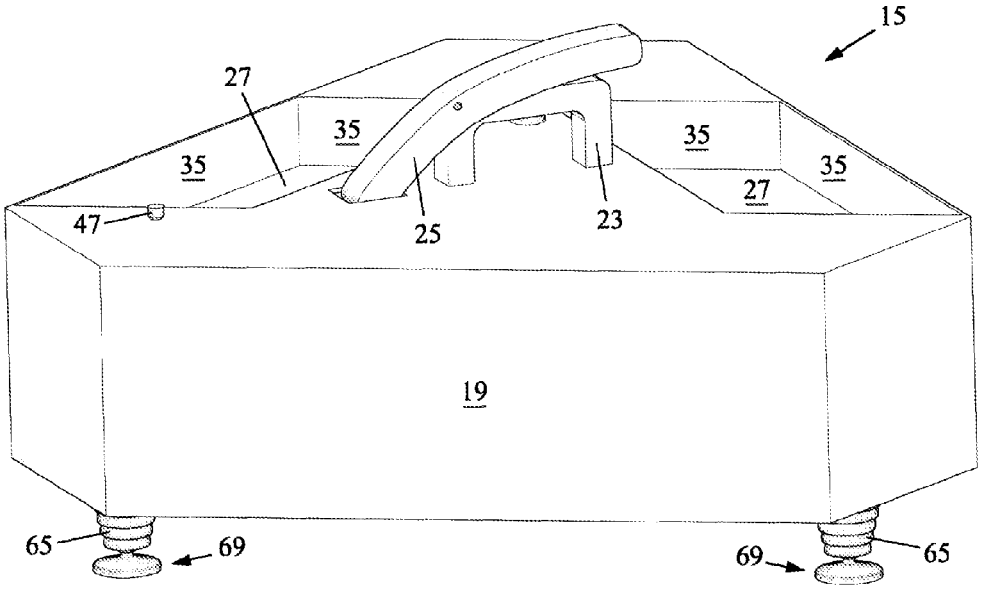
FIG. 25 is a perspective view of the ladder support device depicted in FIG. 24 shown without a vertical stopping element for clarity.
Figure 26:
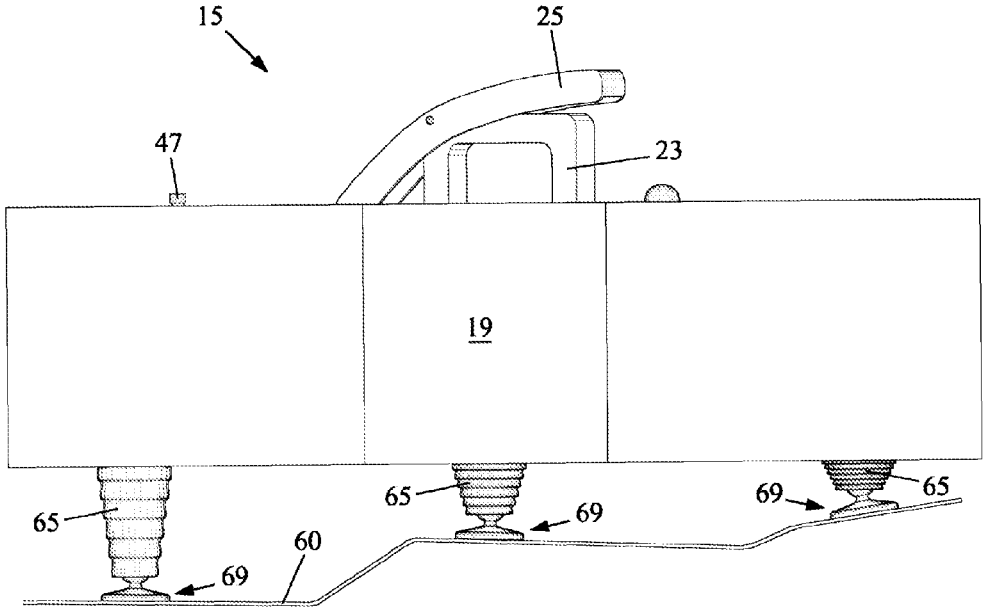
FIG. 26 is a side view of the ladder support device depicted in FIG. 25 leveled on an uneven surface.
Figure 27:
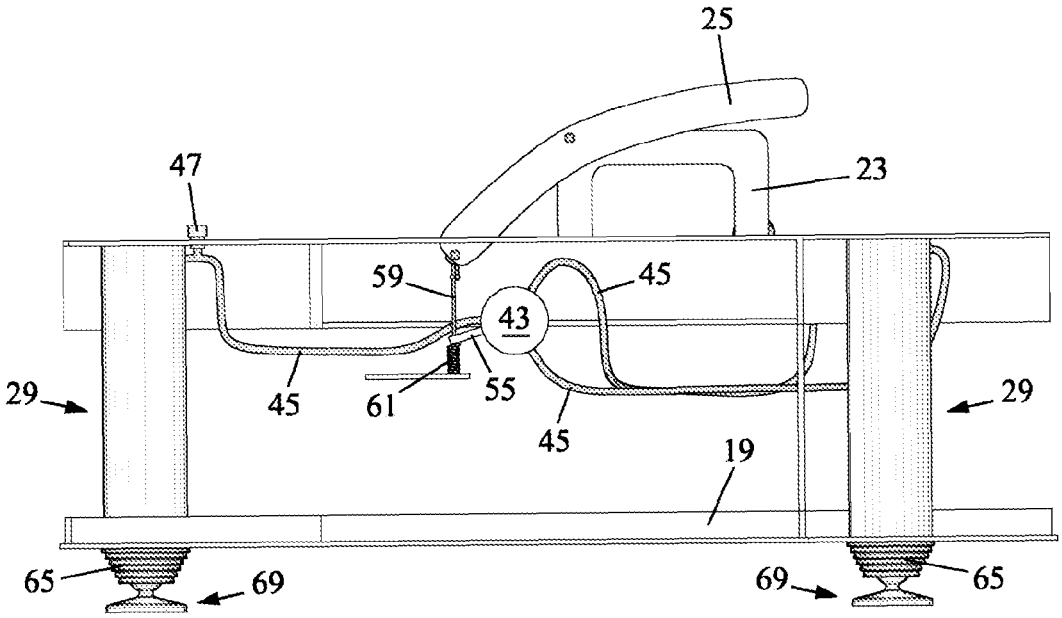
FIG. 27 is a front view of the ladder support device depicted in FIG. 25 with the support platform shown without some of the walls and ribs for clarity where the hydraulic valve is turned off.
Figure 28:
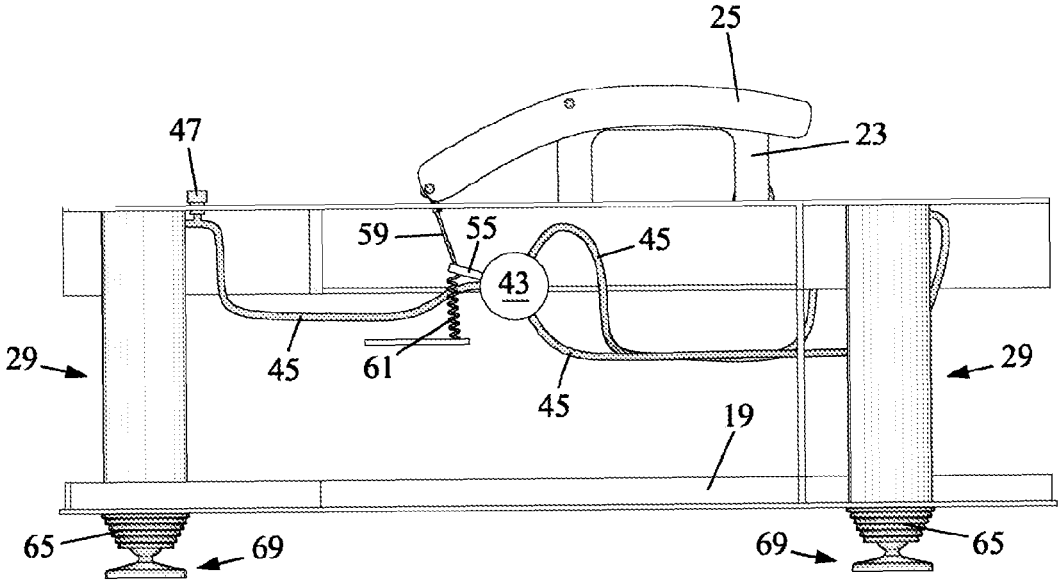
Figure 32:
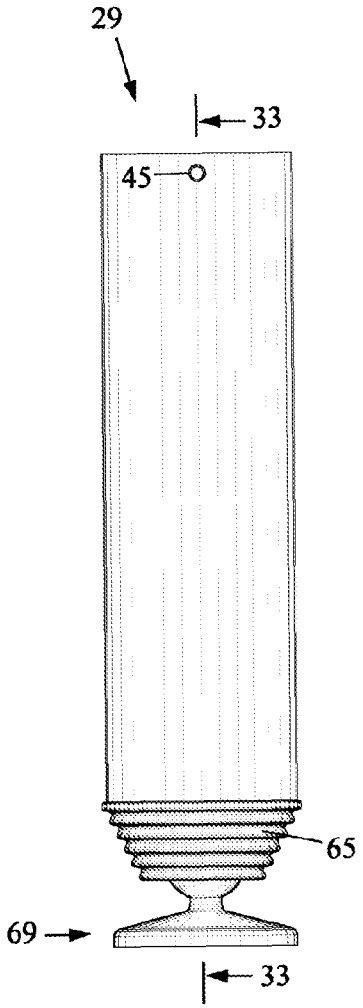
FIG. 32 is a partial front view of a hydraulic pressure tube connected to a hydraulic pressure guide.
Figure 33:
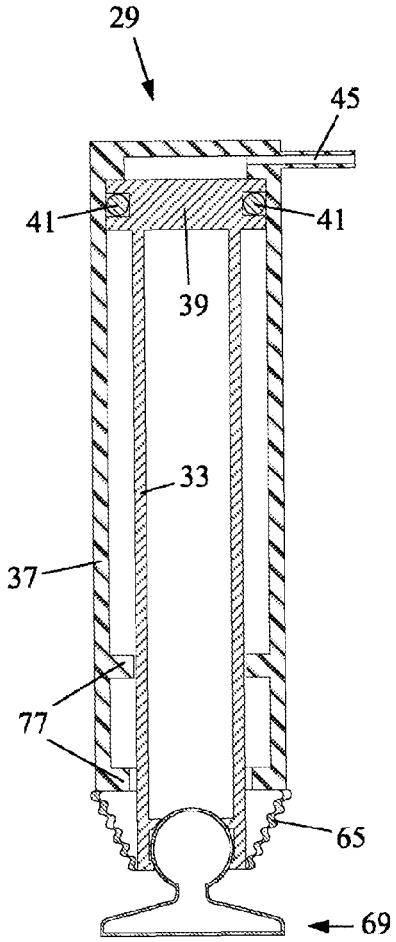
FIG. 33 is a sectional view taken along line 33-33 of the hydraulic pressure tube and the hydraulic pressure guide depicted in FIG. 32.

FIGS. 21-23 depict embodiment demonstrated in FIGS. 1A-20 but with handle 100 flexibly connected to support platform 18 with a ball joint 102, release lever 104 pivotally connected to support platform 18 by an axis 106. Ladder support device 10 is balanced about handle 100 in such way that gravity force keeps work area 26 horizontal regardless of orientation of handle 100 held by a user when support elements 20 are not touching a solid surface. This way user error when orienting support platform 18 horizontally and time required for the orientation are eliminated. In addition, an inclinometer is no longer necessary.

FIGS. 24-33 depict another embodiment of ladder support device 15. Support platform 19 comprises handle 23 fixed to its upward side, a release lever 25, a work area 27, and three guides 29. Although, for demonstrative purposes, support platform 19 is chosen to be triangular, it can be circular, square, or have any other shape; and the number of guides 29 can be more than three, if desired. Work area 27 is a ladder-supporting area incorporating vertical stopping elements 35 limiting the horizontal movement of a ladder lower end on the ladder-supporting area.

Each guide 29 (FIG. 33) comprises a hydraulic cylinder 37, a piston 39 movable within hydraulic cylinder 37 along guides 77, piston 39 is sealed by O-ring 41 (although other sealing means, known in the art, for hydraulic applications can be used). Piston 39 is rigidly connected to a support element 33. Support element 33 ends with a shoe 69 identical to shoe 62 depicted in FIGS. 11A and 11B and described in paragraph [0126]. Lower end of support element 33 is connected to hydraulic cylinder 37 by a dust cover 65. Ladder support device 15 further comprises a hydraulic valve 43 (see FIGS. 31A and 31B) comprising outer casing 49 and inner member 51 located inside of outer casing 49. Outer casing 49 is connected to each of hydraulic cylinders 37 by a hydraulic pressure tubes 45, at least one of hydraulic pressure tubes 45 comprises a fill and bleed access member 71 sealed by a cap 47. Inner member 51 comprises a lever 55 protruding through a channel 57 of outer casing 49. Inner member 51 further comprises three interconnected channels 53 leading to the outside surface of inner member 51. Lever 55 is connected to release lever 25 by a cable 59 and is biased downward by a tension spring 61 keeping hydraulic valve 43 turned off. In the biased position inner member 51 blocks all hydraulic pressure tubes 45 (FIG. 31B) for preventing hydraulic fluid communication between hydraulic cylinders 37. Squeezing release lever 25 toward handle 23 turns hydraulic valve 43 on (FIGS. 28 and 29) by raising lever 55 which pulls tension spring 61 and pivots inner member 51 resulting in alignment of channels 53 with hydraulic pressure tubes 45 and hydraulic fluid communication between hydraulic cylinders 37. Releasing lever 25 will allow unrealized force of spring 61 to pivot inner member 51 back to the biased position where channels 53 are not aligned with hydraulic pressure tubes 45 preventing hydraulic fluid communication between hydraulic cylinders 37.

Therefore, a user is able to position the bottom ends of all of support elements 33 on the ground quickly, automatically, and regardless of the ground profile (FIG. 26) by squeezing release lever 25 toward handle 23 (FIG. 28) for redirecting the hydraulic liquid from hydraulic cylinders 37 of support elements 33 pressed against solid surface 60 to hydraulic cylinders 37 of support elements 33 which are not touching solid surface 60 until all of support elements 33 reach solid surface 60 equalizing pressure between hydraulic cylinders 37 where releasing lever 25 by the user fixates the position of support platform 19 about solid surface 60 since hydraulic liquid redirection between hydraulic cylinders 37 is no longer permitted.

FIGS. 34-59 depict another sample embodiment of a ladder support device 110. Ladder support device 110 (FIG. 34) is used with a ladder 12 having spaced side rails 14 connected by spaced rungs 16. Ladder support device 110 comprises a flexible bar 112 (best seen in FIG. 37), two short support elements 114 (FIG. 36), two long support elements 116, and a generally rectangular frame 120 formed by a support platform 118 at the bottom, by a rib 122 on the top, and by two guide pairs 124 on the sides.

For demonstrative purposes, each of support elements 114 and 116 is depicted as a square bar, although others shapes can be chosen. Each of short support elements 114 is longitudinal and comprises a cap 115 at the top and teeth 128 along the longitudinal dimension. Each of long support elements 116 is longitudinal and comprises a cap 115 at the top and teeth 128 along the longitudinal dimension.

Support platform 118 comprises a release pedal 130 and a work area 132. Work area 132 is a ladder-supporting area incorporating vertical stopping elements 134 limiting the horizontal movement of a ladder lower end on the ladder-supporting area.

Each guide pair 124 comprises an inner guide 136 and an outer guide 138 connected to each other by two arms 140 at the bottom ends and pivotally connected to each other at the upper end with an axis 142. Arms 140 are pivotal about axes 144. User folds each guide pair 124 for storage (FIG. 38) by rotating outer guides 138 toward inner guides 136 about axis 142 and rotating simultaneously arms 140 about axes 144. User unfolds each guide pair 124 (FIG. 36), when preparing ladder support device 110, by rotating outer guides 138 from inner guides 136 about axis 142 and rotating simultaneously arms 140 about axes 144.

Figure 57:
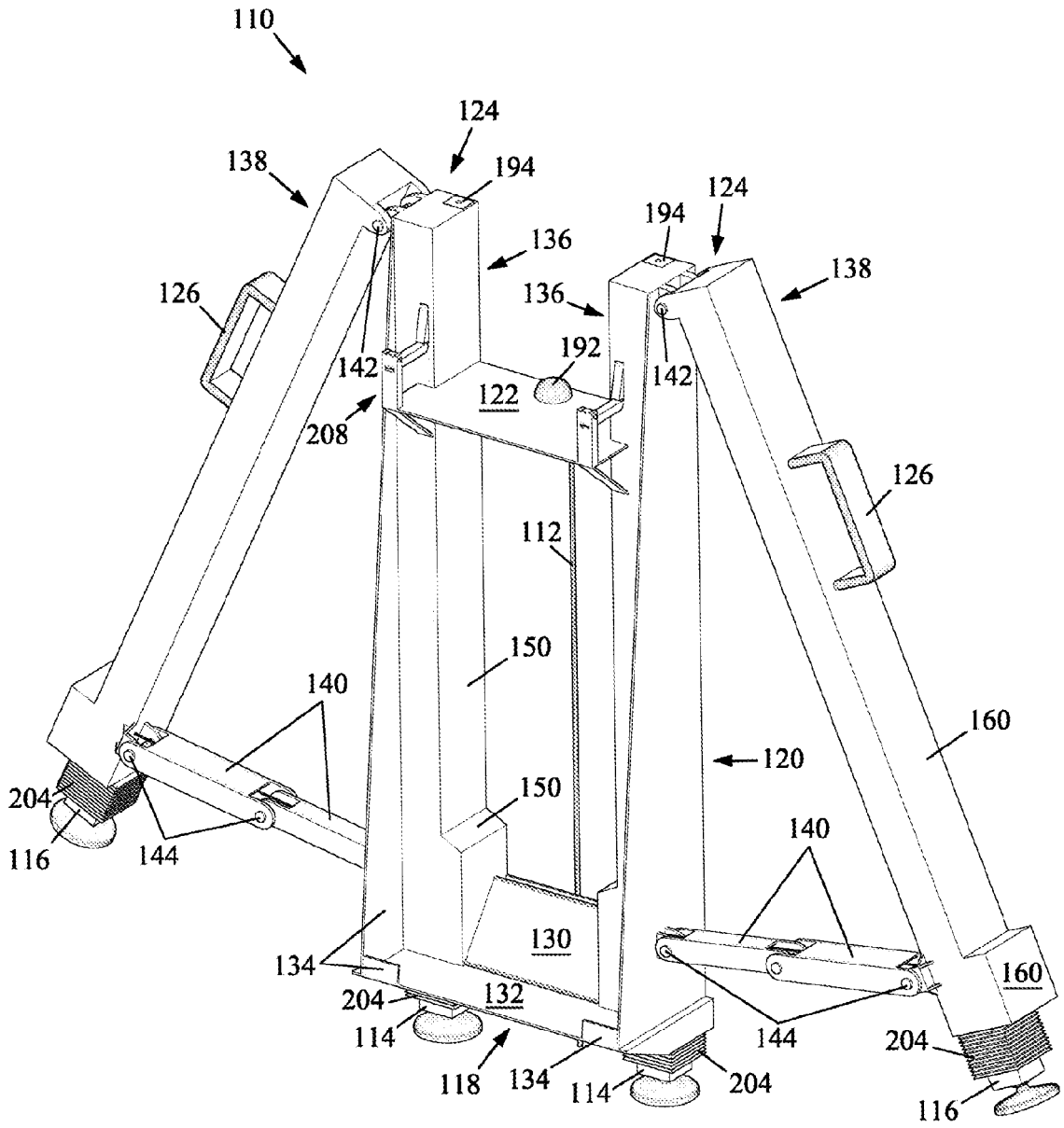
FIG. 57 is a perspective view of the ladder support device depicted in FIG. 36 shown with the covers and the dust covers.
Figure 58:
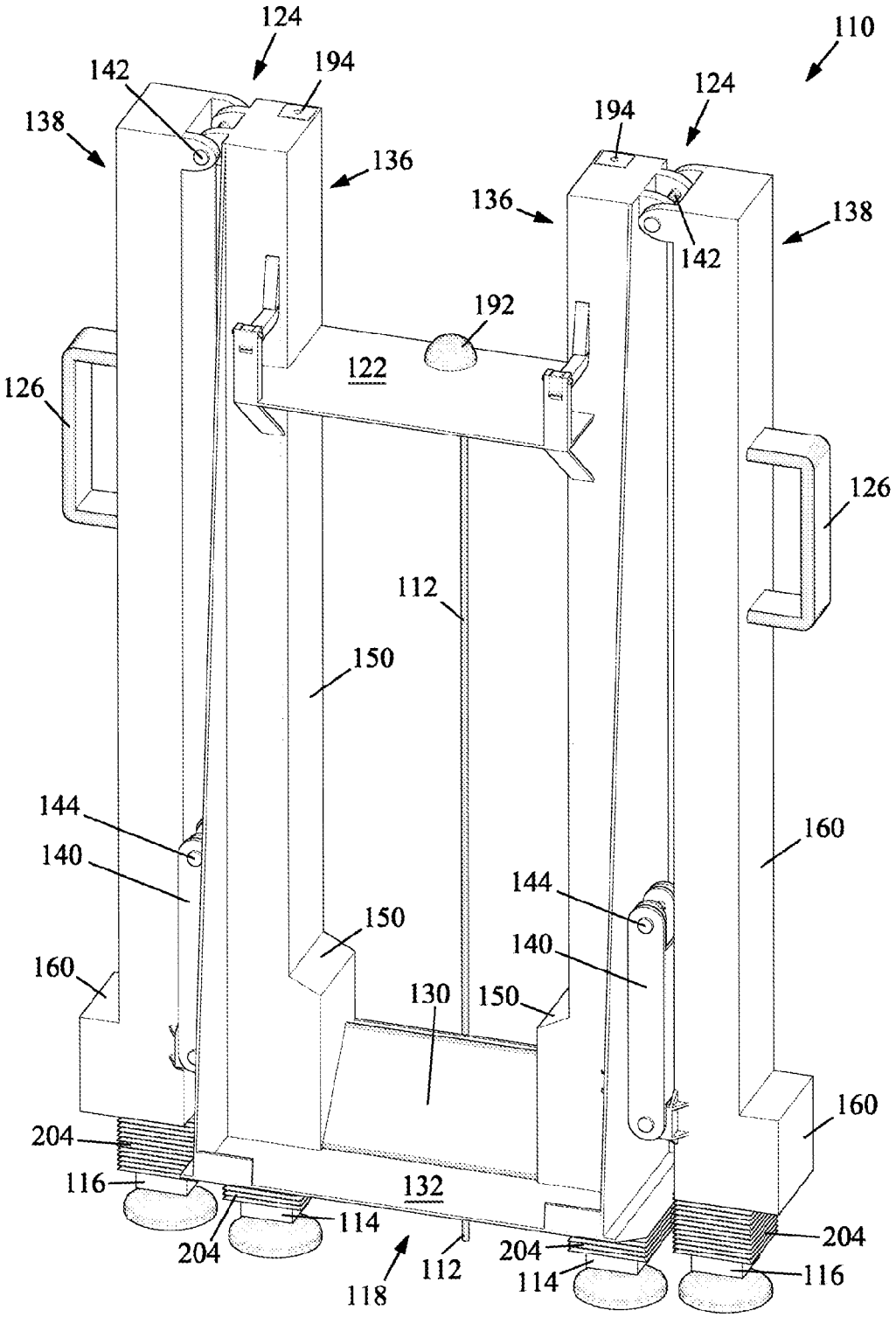
FIG. 58 is a perspective view of the ladder support device depicted in FIG. 38 shown with the covers and the dust covers.
Figure 59:
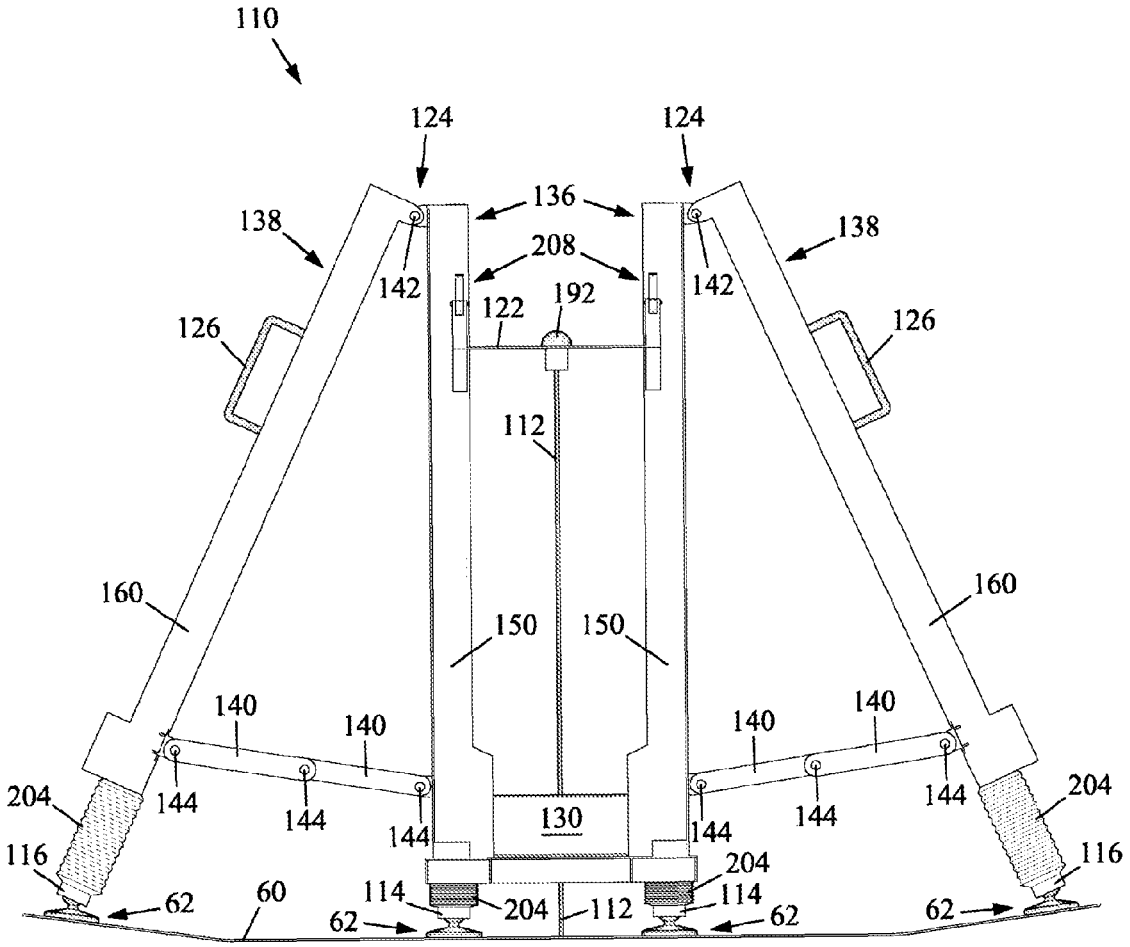
FIG. 59 is a front view of the ladder support device depicted in FIG. 57 leveled on an uneven surface.

Each of inner guides 136 comprises a U-shaped bar 146 (FIG. 36), a latch 148 (FIG. 39), a cover 150 (FIG. 57) enclosing latch 148 and short support element 114, and a dust cover 204 connecting the lower end of short support element 114 to the bottom of cover 150 (only FIGS. 57-59 fully depict cover 150 and dust cover 204 where FIGS. 34-44, and 49-51 depict cover 150 with some of the walls removed for clarity). Cover 150 is removable and attached to U-bar 146, for instance, with fasteners (not shown).

Figure 34:
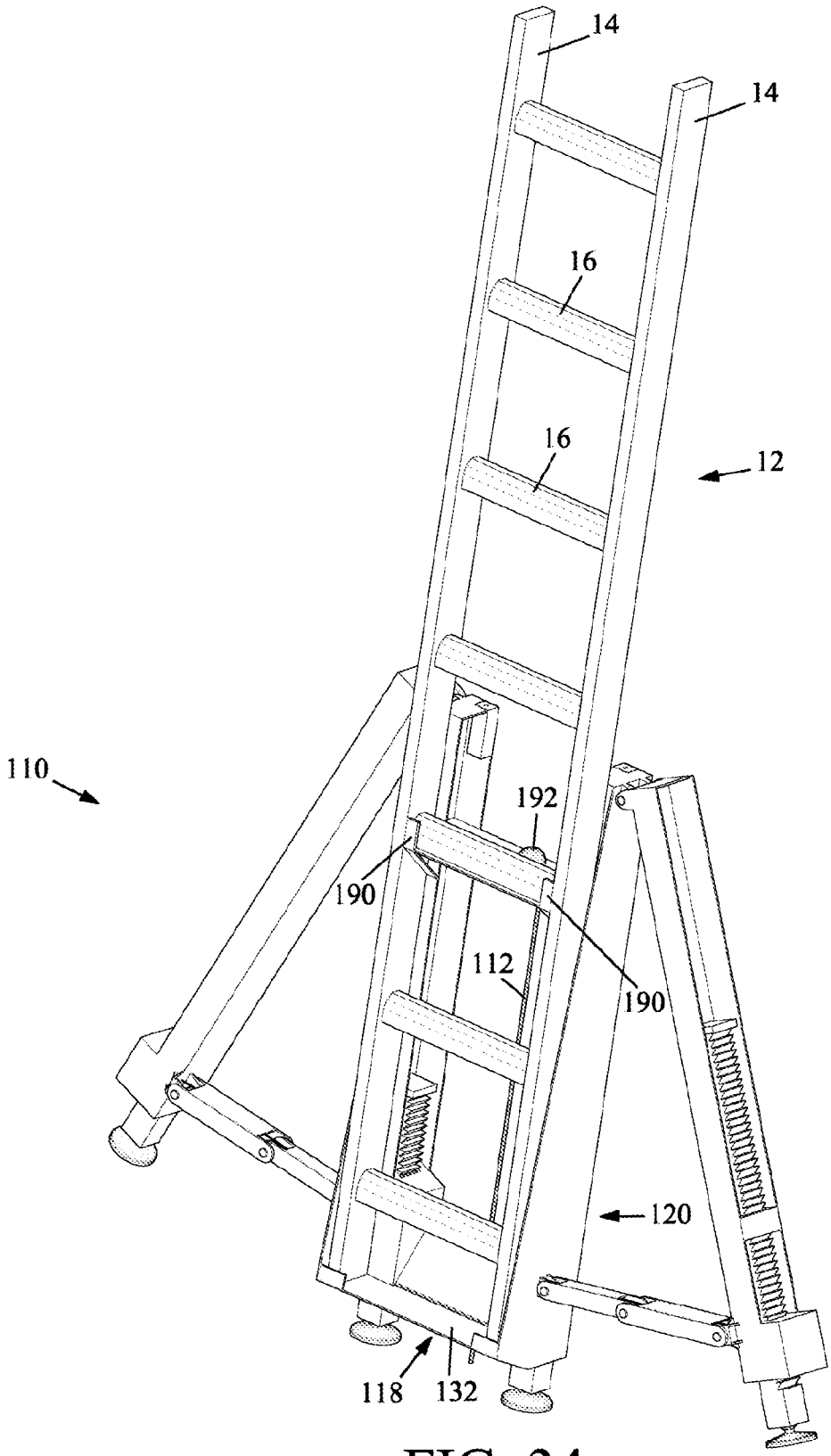
FIG. 34 is a perspective view of a ladder and a ladder support device comprising four support elements and two holders for holding the ladder in place where the outer guides are unfolded and the ladder support device is shown without dust covers and without some of the frame walls for clarity.
Figure 35:
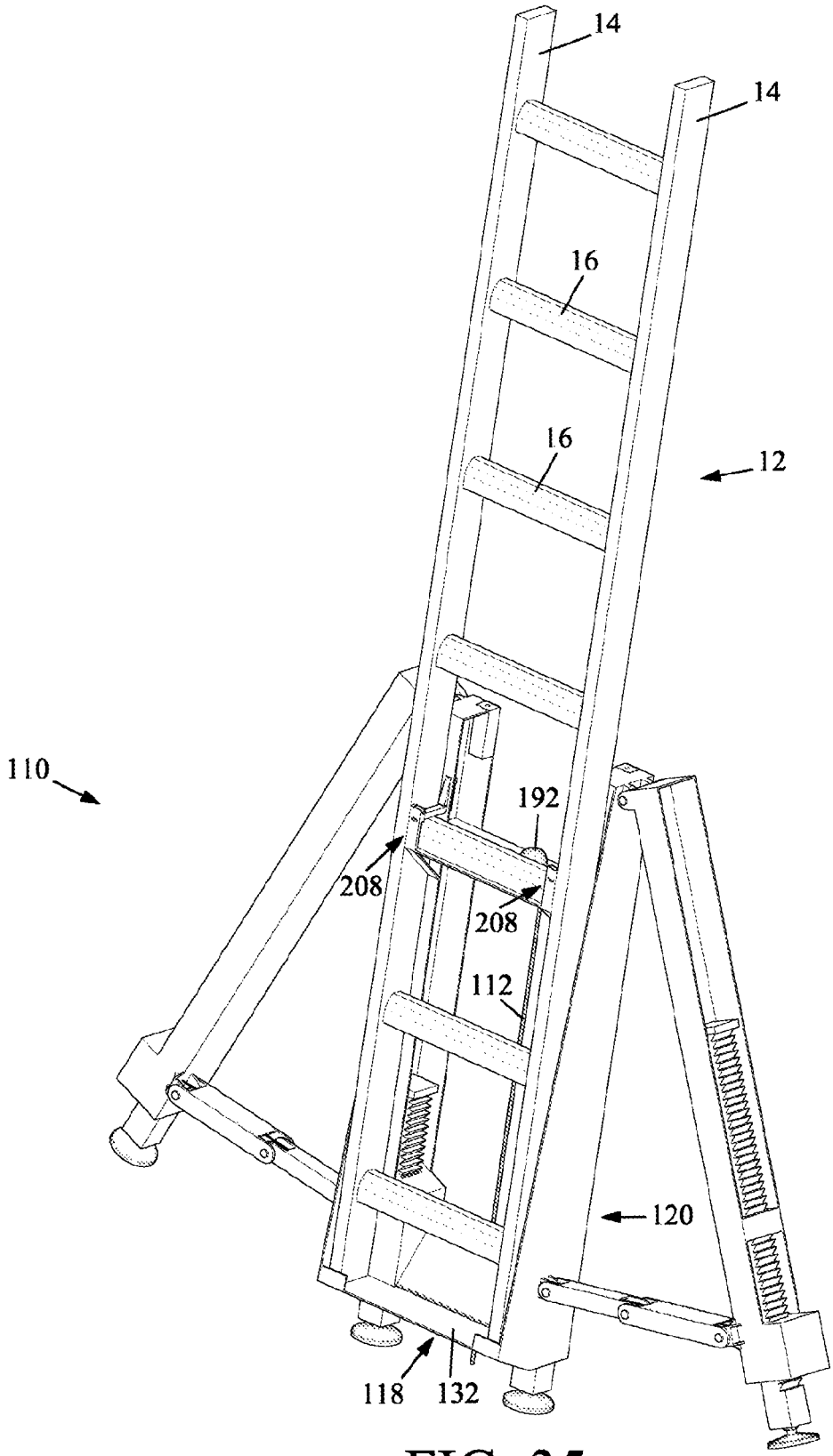
FIG. 35 is a perspective view of a ladder and a ladder support device comprising four support elements and two locking holders for securing the ladder in place where the outer guides are unfolded and the ladder support device is shown without dust covers and without some of the frame walls for clarity.
Figure 36:
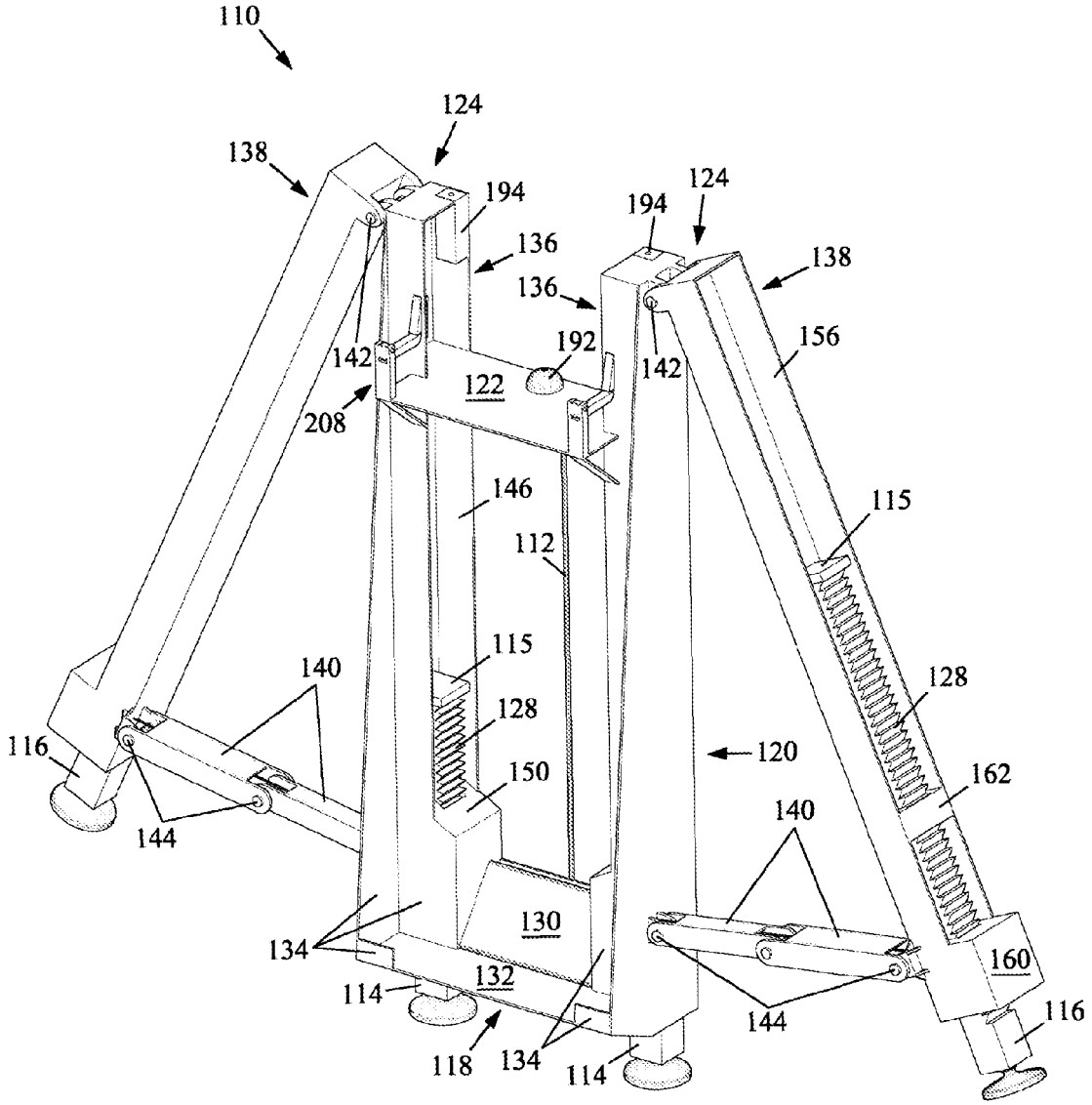
FIG. 36 is a front perspective view of the ladder support device depicted in FIG. 35 shown without the ladder.
Figure 37:
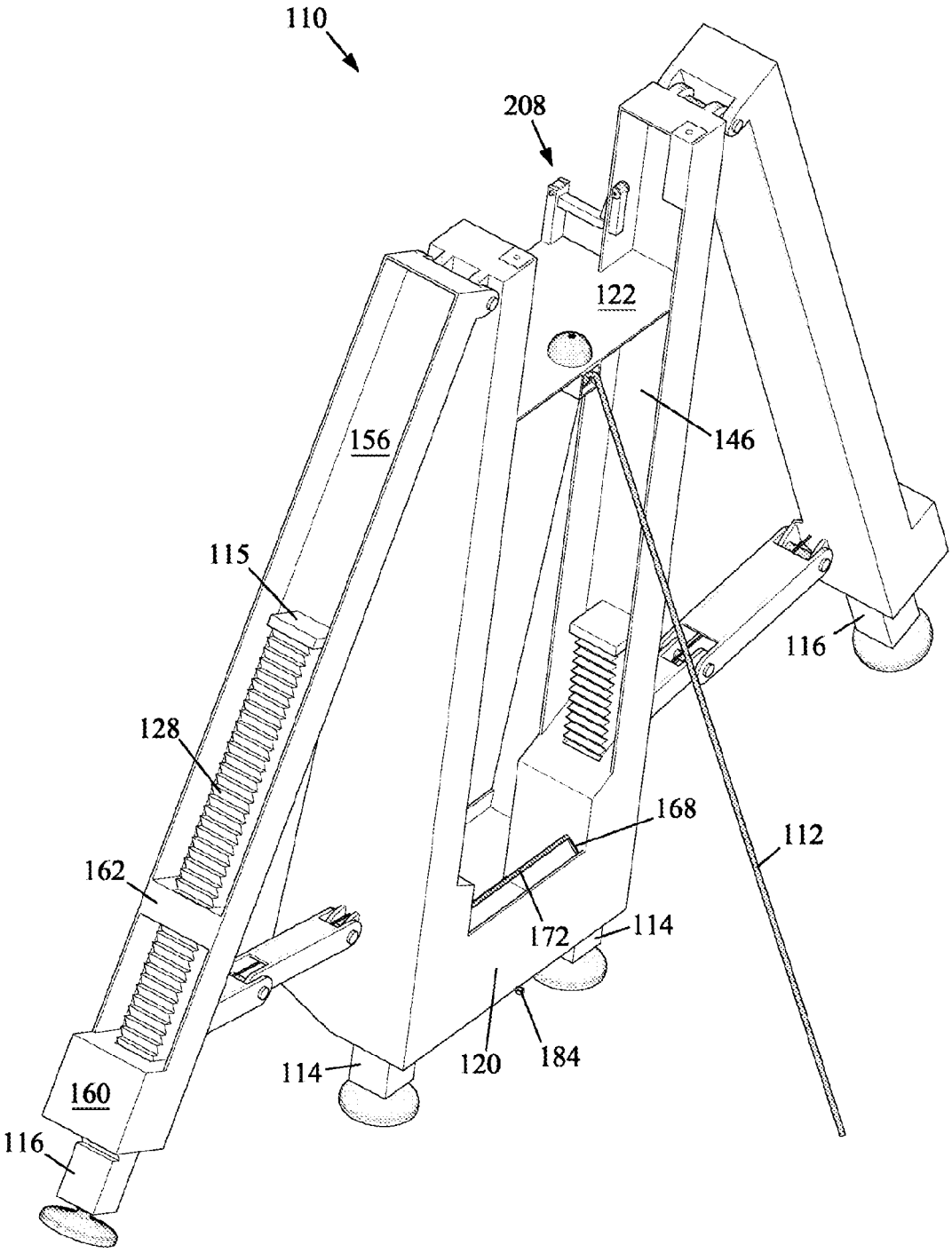
FIG. 37 is a back perspective view of the ladder support device depicted in FIG. 36 shown with the flexible bar extended.
Figure 38:
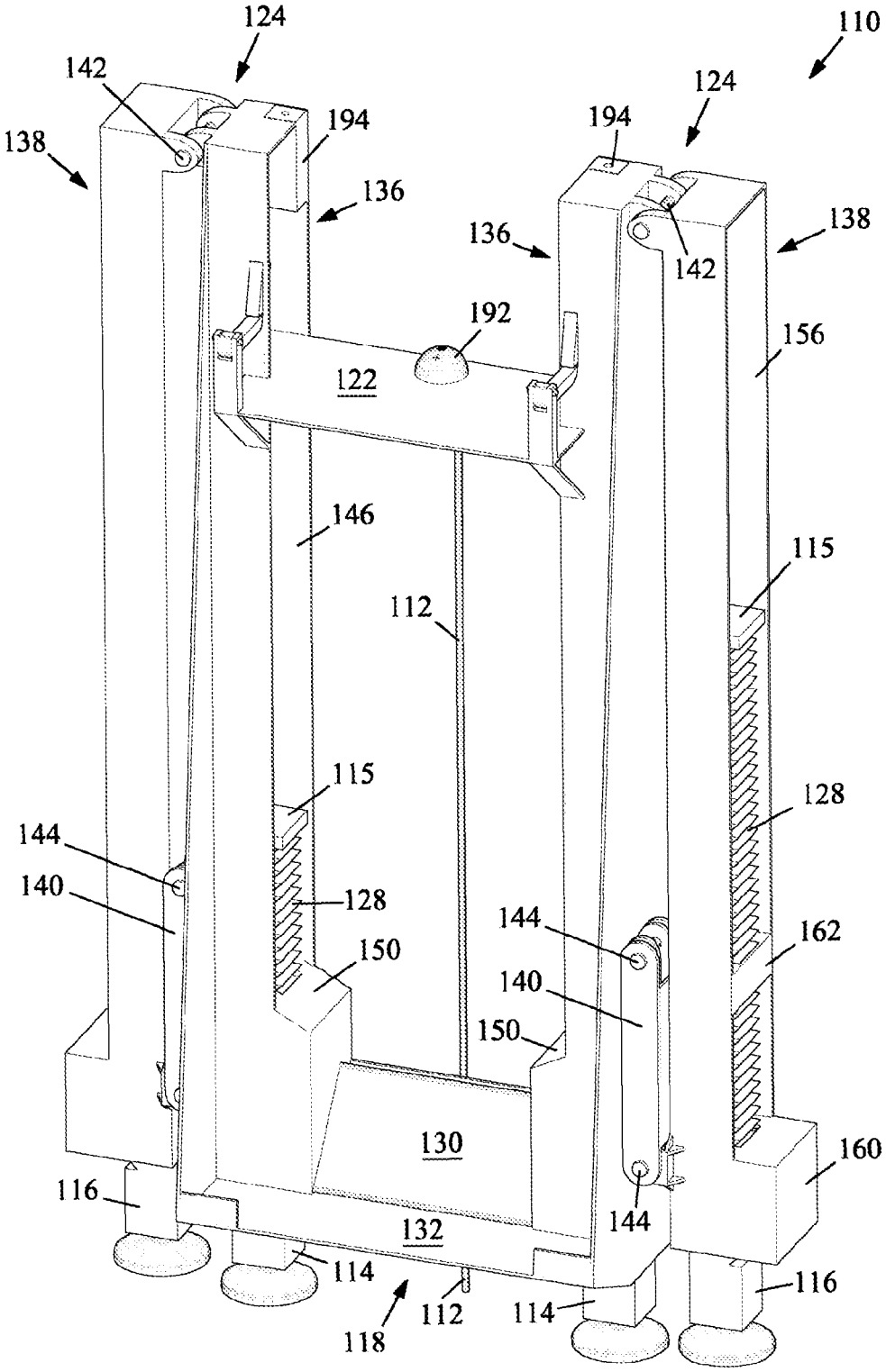
FIG. 38 is a front perspective view of the ladder support device depicted in FIG. 36 shown with the outer guides folded.
Figure 39:
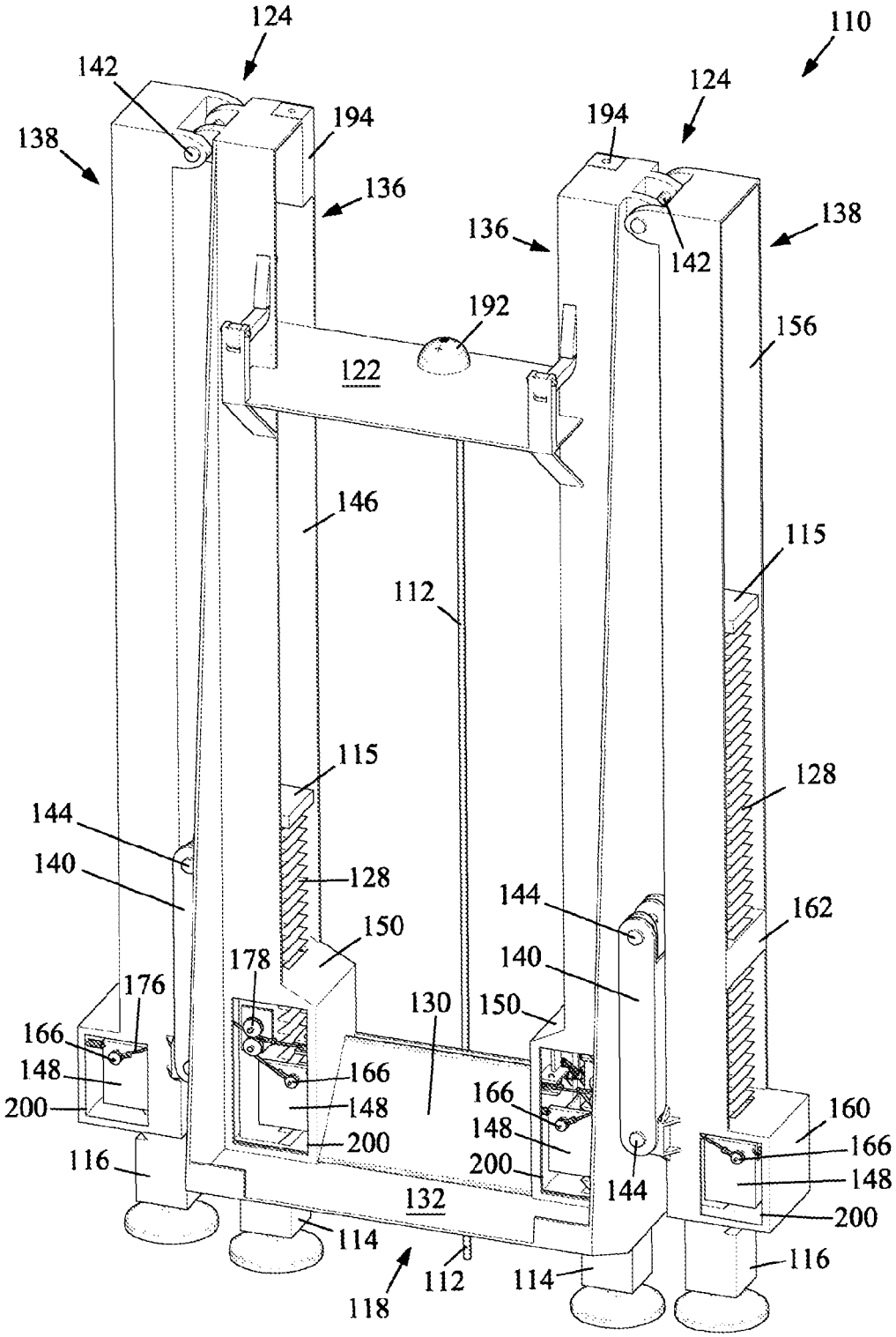
FIG. 39 is a front perspective view of a ladder support device comprising transparent plates where the ladder support device is shown without dust covers and without some of the frame walls for clarity.
Figure 40:
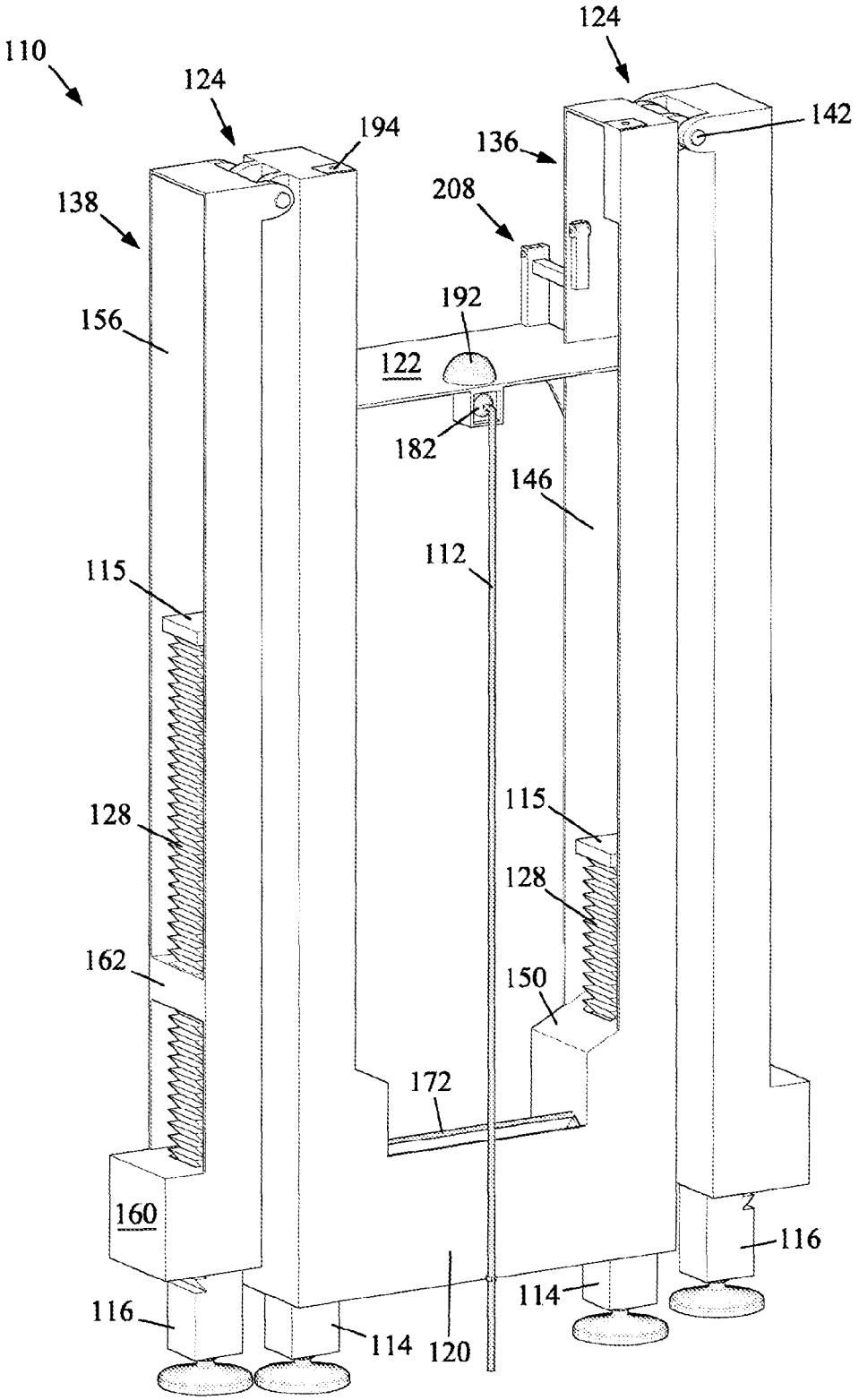
FIG. 40 is a back perspective view of the ladder support device depicted in FIG. 38.
Figure 41:
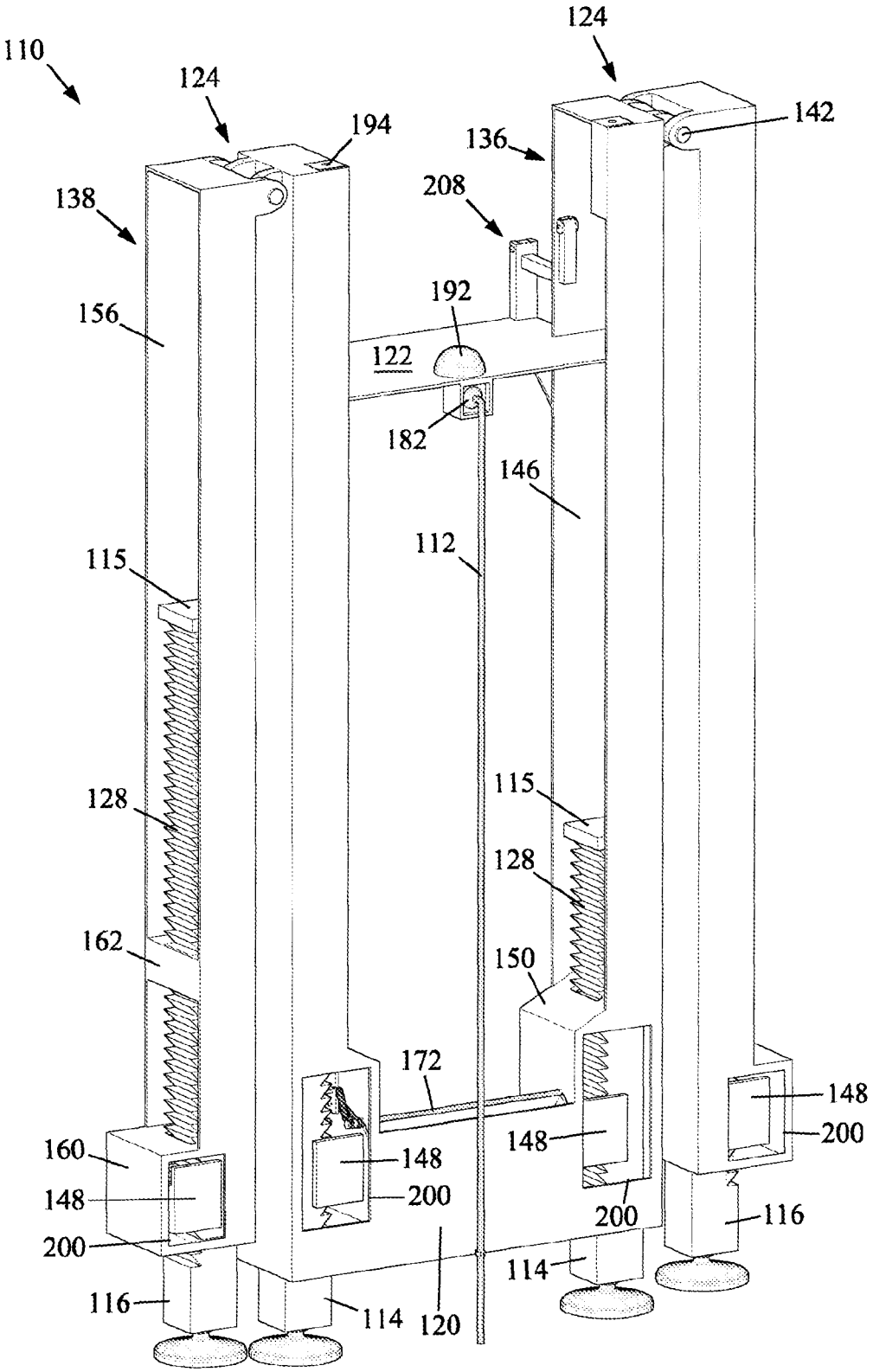
FIG. 41 is a back perspective view of the ladder support device depicted in FIG. 39.

Each of outer guides 138 (FIG. 39) comprises a U-shaped bar 156, latch 148, a cover 160 (FIG. 57) enclosing latch 148 and long support element 116, and a dust cover 204 connecting the lower end of long support element 116 to the bottom of the cover 160 (only FIGS. 57-59 fully depict cover 160 and dust cover 204 where FIGS. 34-42, 44, and 49 depict cover 160 with some of the walls removed for clarity). U-shaped bar 156 comprises a limiting member 162 (FIG. 36). Cap 115 limits movement of long support element 116 along the longitudinal dimension of U-bar 156 when cap 115 meets limiting member 162. Each cover 160 comprises a handle 126 (FIGS. 57 and 58). Cover 160 is removable and attached to U-bar 156, for instance, with fasteners (not shown).

Latch 148 is identical to latch 38 of ladder support device 10 depicted in FIGS. 1A-23. Latch 148 comprises a tooth 164 (best seen in FIGS. 47 and 48). Latch 148 is pivotally connected to its guide with an axis 166 and by a tension spring 152.

Figure 50:
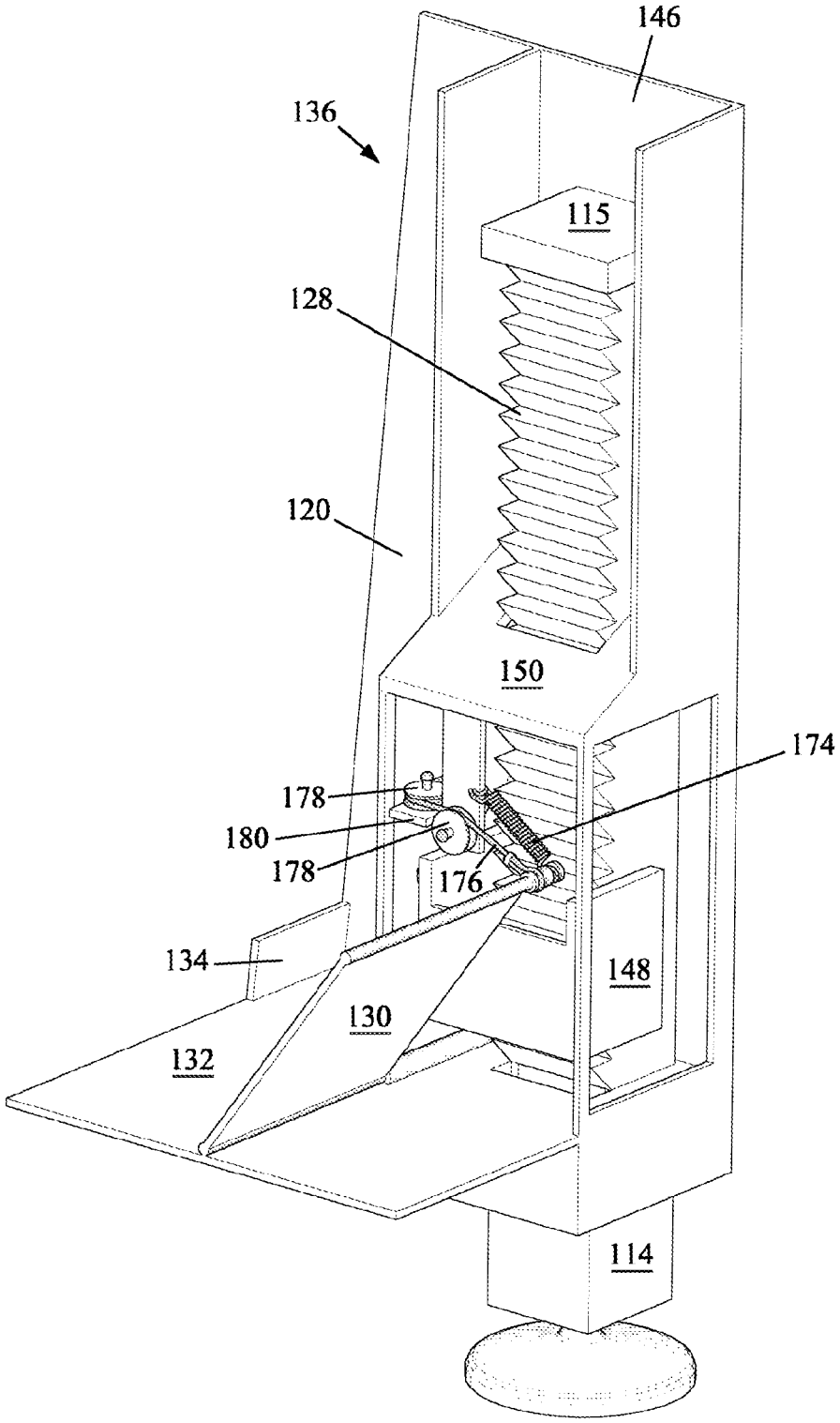
FIG. 50 is a partial perspective view of the release pedal and one of the inner guides of the ladder support device depicted in FIG. 36 shown without some of the walls and ribs for clarity.
Figure 51:
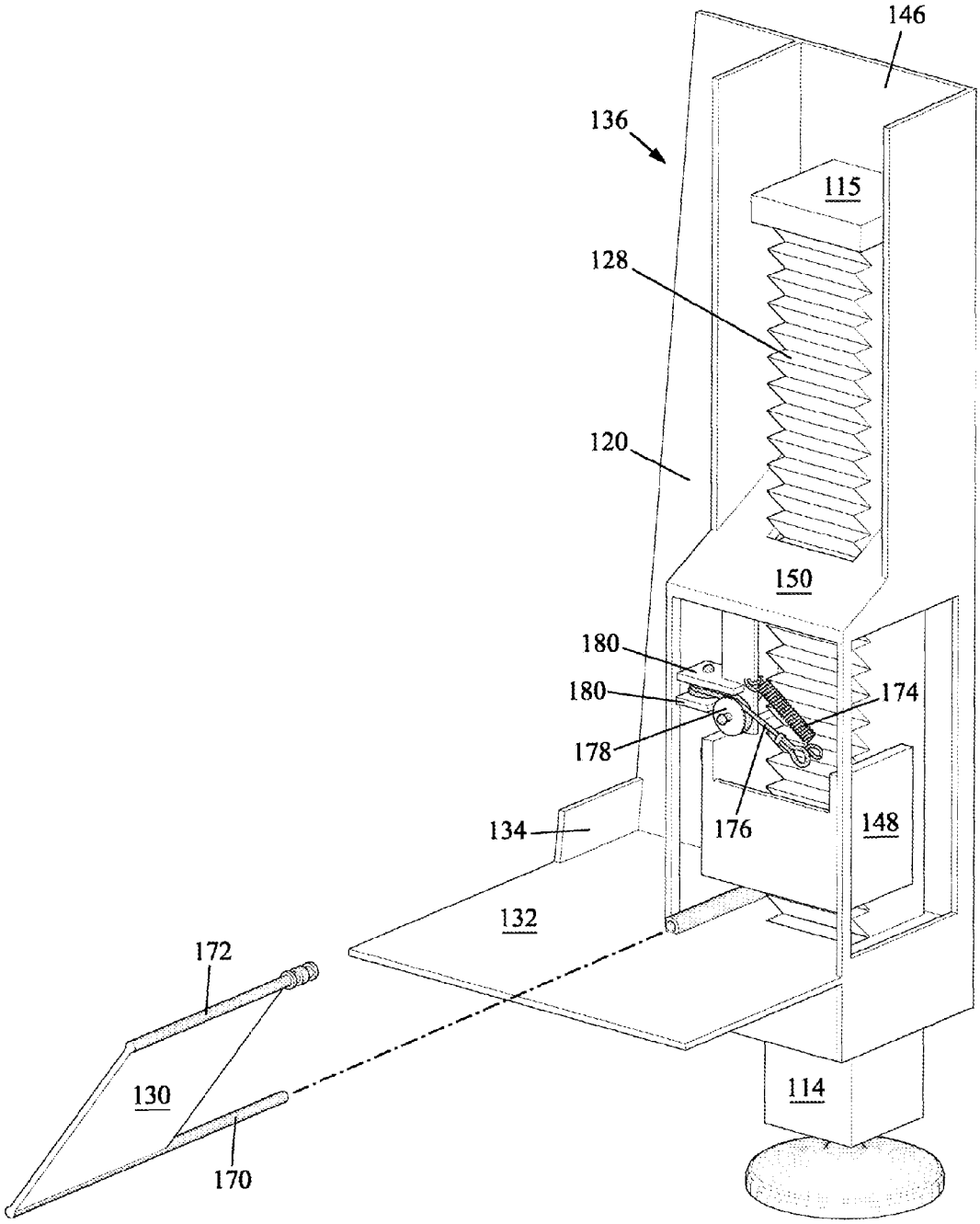
FIG. 51 is an exploded view of the release pedal and the inner guide depicted in FIG. 50.

Release pedal 130 comprises bottom axis 170 and top axis 172 (best seen in FIG. 51). Release pedal 130 is pivotally connected to inner guides 136 with bottom axis 170. Both ends of top axis 172 are positioned inside of arc-shaped channels 168 (best seen in FIG. 43B) of inner guides 136 limiting rotational movement of release pedal 130 about bottom axis 170. Release pedal 130 is biased upward by two tension springs 174 connected to opposite ends of top axis 172 with one end (only one end of top axis 172 is shown in FIGS. 50 and 51 for clarity) and to inner guides 136 with the other end. Each end of top axis 172 is also connected to both latches 148 of its own guide pair 124 by cable 176 routed by pulleys 178 (FIGS. 47, 48, 50, and 51) installed between ribs 180 (shown partially in FIGS. 50 and 51 for clarity).

Figure 1B:
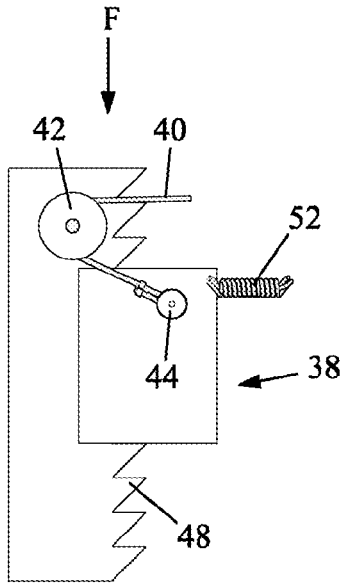
FIG. 1B is a partial side view of a latch engaged with a support element.
Figure 1C:
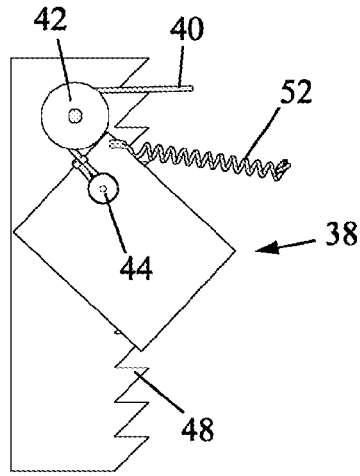
FIG. 1C is a partial side view of a latch disengaged from a support element.
Figure 1D:
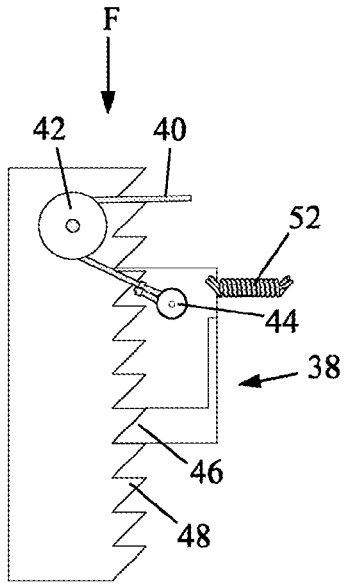
FIG. 1D is a partial side view of a latch tooth engaged with a support element tooth shown without a side wall of the latch for clarity.
Figure 1E:
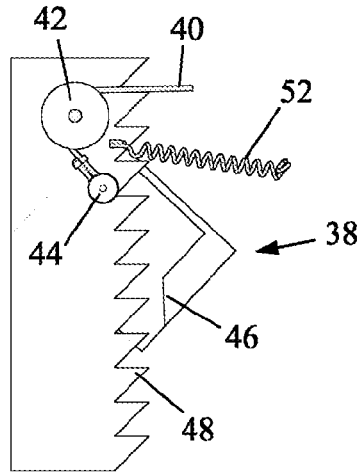
FIG. 1E is a partial side view of a latch tooth disengaged from a support element tooth shown without a side wall of the latch for clarity.

Tension springs 152, when not pulled, (FIGS. 44 and 47) keep teeth 164 of latches 148 engaged with teeth 128 of support elements 114 and 116 preventing movement of support elements 114 and 116 about support platform 118 (see also FIGS. 1B and 1D).

Figure 52:
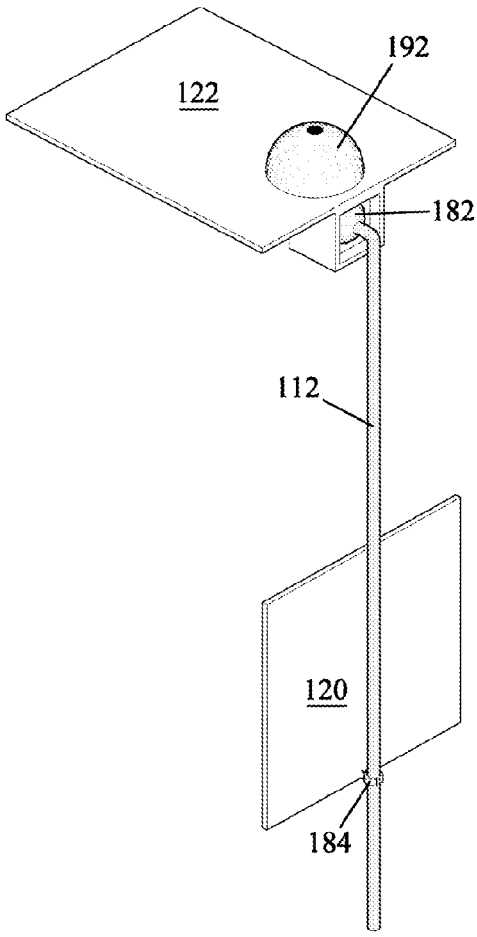
FIG. 52 is a perspective view of the flexible bar depicted in FIG. 41 shown only with a portion of the top rib and a portion of the frame wall for clarity.
Figure 53:
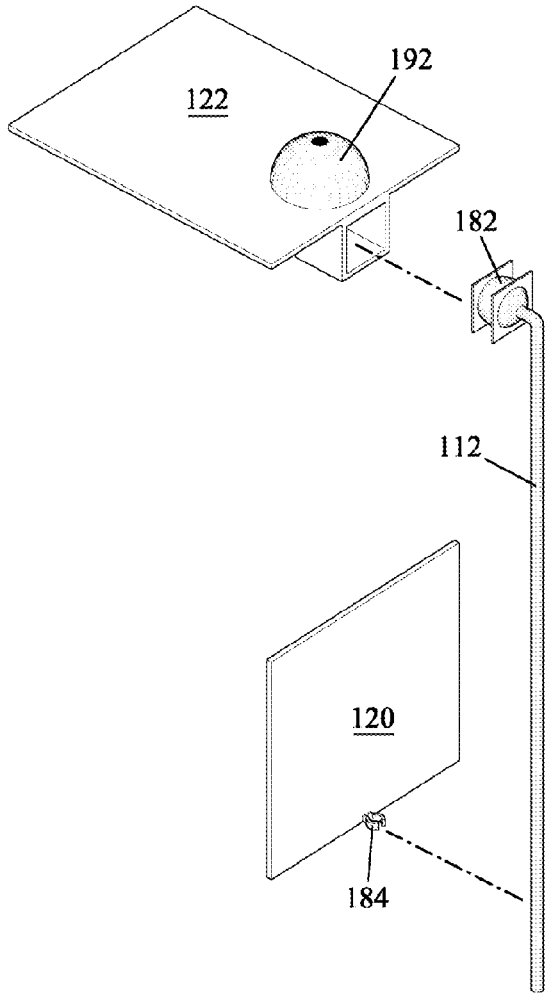
FIG. 53 is an exploded view of the flexible bar depicted in FIG. 52.

Flexible bar 112 is attached to the bottom side of rib 122 by a ball joint 182 and to frame 120 by a spring latch 184 (best seen in FIGS. 52 and 53).

Frame 120 further comprises two holders 190 (FIG. 34) and an inclinometer 192.

Each inner guide 136 further comprises a laser guide 194 (FIG. 36).

In use, a user unfolds guide pairs 124, pulls bottom portion of flexible bar 112 from spring latch 184, positions the ladder support device 110 on solid surface 60 at a desired location using, for instance, handles 126, and levels it using reading of inclinometer 192 and laser beams of laser guides 194 indicating a location the top end of ladder 12 is about to be leaned on when ladder 12 is positioned on work area 132; next, the user presses upper portion of release pedal 130 (FIG. 43B); as a result, release pedal 130 is pivoted about bottom axis 170 extending tension springs 174 and pulling all cables 176 which, in turn, cause simultaneous pivotal movement of latches 148 and disengagement of all teeth 164 (FIG. 48) from teeth 128 while pulling all tension springs 152; since support elements 114 and 116 are no longer fixated respectively to guides 136 and 138 with teeth 164, support elements 114 and 116 move simultaneously toward solid surface 60 under force of gravity; when all of support elements 114 and 116 meet solid surface 60, user stops pressing release pedal 130; as a result, release pedal 130 is pivoted by decompression force of springs 174 releasing all cables 176 which, in turn, allows the release force of springs 152 to pivot teeth 164 until they engage with teeth 128 fixating the positions of support elements 114 and 116 about solid surface 60 regardless of the profile of solid surface 60.

Figure 43A:
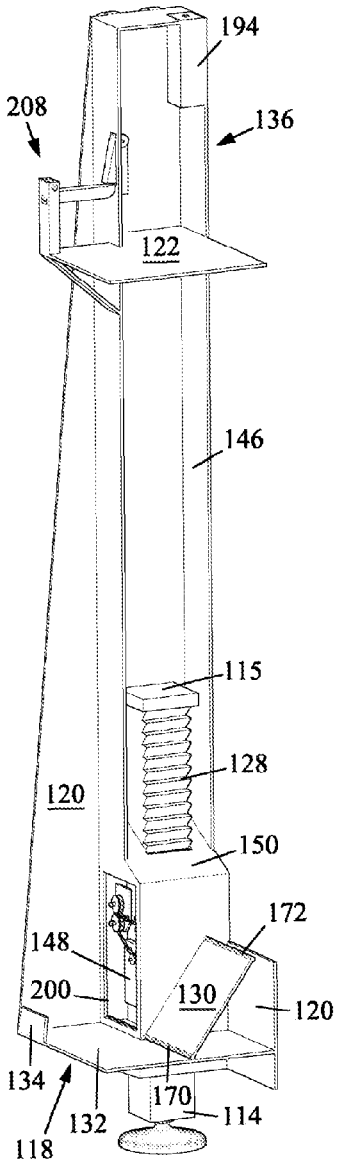
FIG. 43A is a partial perspective view of a ladder support device demonstrating the fully disengaged release pedal hiding the markings.
Figure 43B:
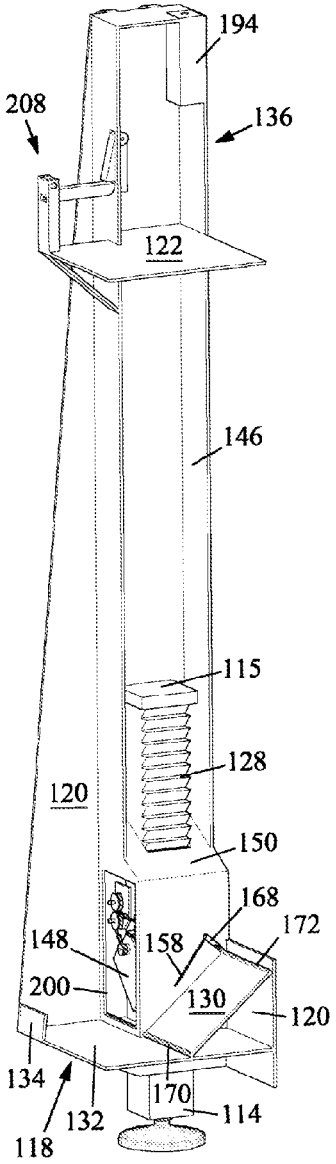
FIG. 43B is a partial perspective view of a ladder support device demonstrating the fully engaged release pedal exposing the markings.
Figure 43C:
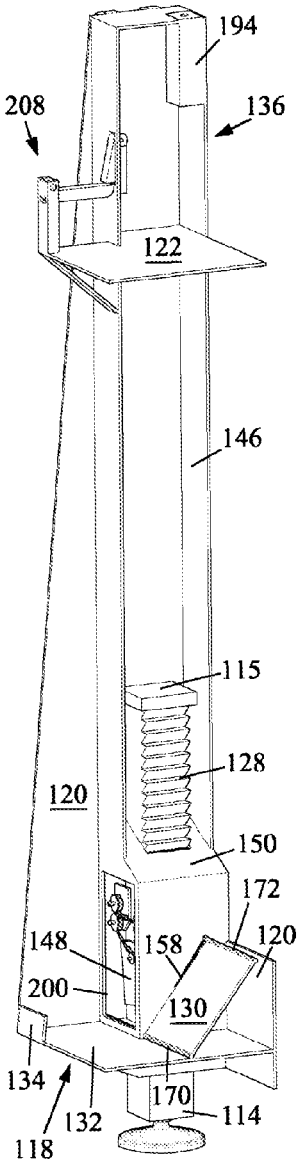
FIG. 43C is a partial perspective view of a ladder support device demonstrating the partially disengaged release pedal exposing the markings.
Figure 44:
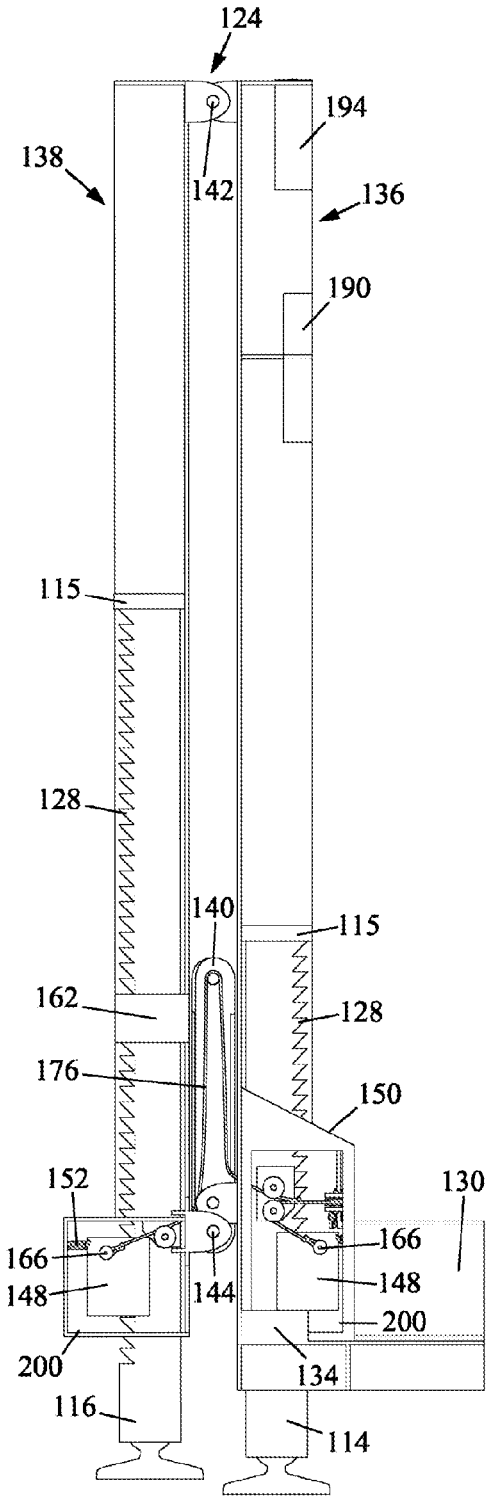
FIG. 44 is a front view of one of the guide pairs of the ladder support device depicted in FIG. 38 shown without some of the walls for clarity.
Figure 45:
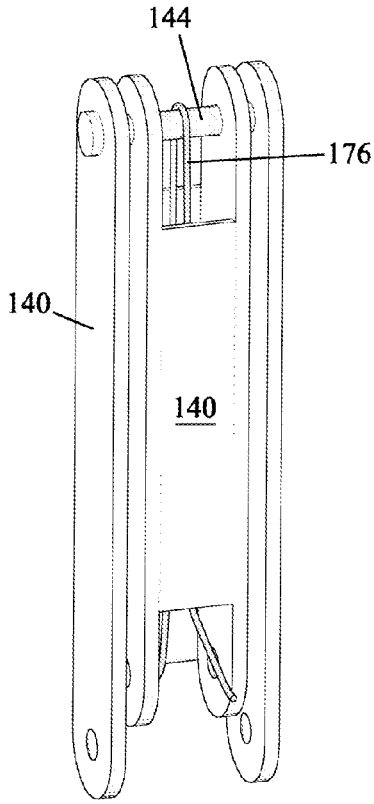
FIG. 45 is a perspective view of arms connecting the guides of one of the guide pairs depicted in FIG. 38.
Figure 46:
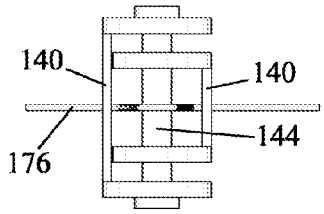
FIG. 46 is a top view of the arms depicted in FIG. 45.
Figure 47:
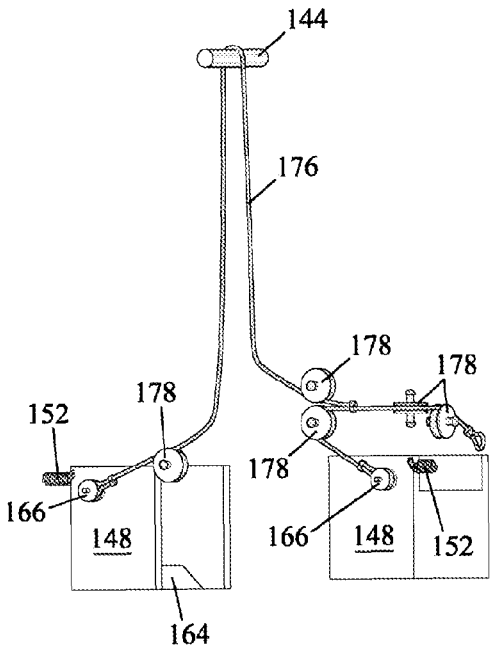
FIG. 47 is a perspective view of the latches, cables, axes, and pulleys of the guide pair depicted in FIG. 44.
Figure 48:
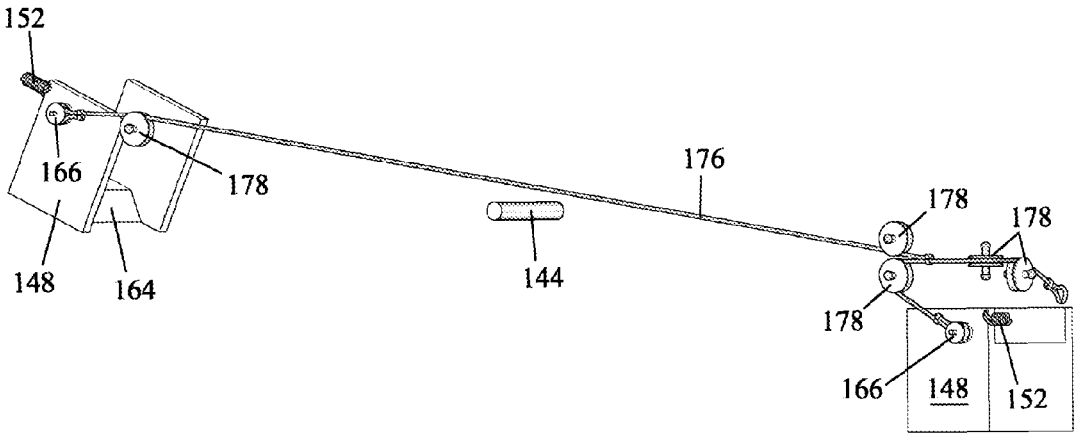
FIG. 48 is a perspective view of the latches, cables, axes, and pulleys of the guide pair depicted in FIG. 36.
Figure 49:
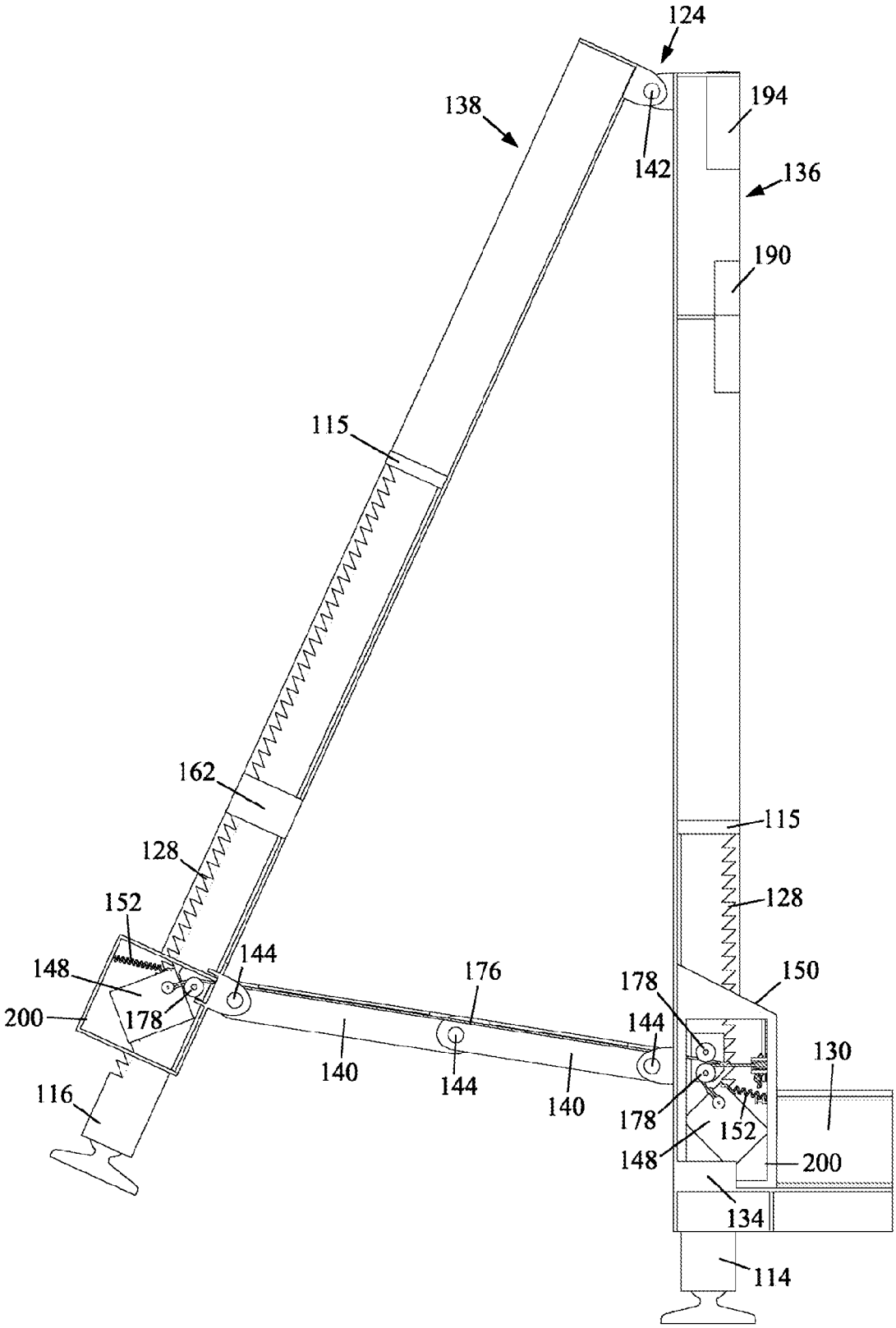
FIG. 49 is a front view of a guide pair of the ladder support device depicted in FIG. 36 shown without some of the walls for clarity.

If any tooth 164 is not engaged right away with teeth 128, tension spring 152 is not fully released keeping tension spring 174 from being released by cable 176 and resulting in partial return of release pedal 130 exposing markings 158 (FIG. 43C); exposed markings 158 indicate to the user that the ladder support device is not ready; unrealized force of spring 152 will engage tooth 164 with teeth 128 as soon as the support element 114 (116) is moved slightly about support platform 118, for instance, when the user pushes support platform 118 toward solid surface 60 to make sure that markings 158 are hidden (FIG. 43A). The hidden markings 158 indicate to the user that all teeth 164 are engaged with teeth 128 completely and that ladder support device 110 is ready (deployed) for ladder placement. Markings 158 are located on inner sides of inner guides 136 (only one marking 158 is shown in FIGS. 43B and 43C for clarity).

If pushing ladder support device 110 toward solid surface 60 does not make it ready, the user is able to examine the guides 136 and 138 through transparent plates 200 for the reason (an embodiment of ladder support device 110 with transparent plates 200 is shown, for instance, in FIGS. 39, 41, and 43A-43C). After orientating ladder support device 110, user pivots flexible bar 112 about ball joint 182 and positions lower end of flexible bar 112 behind frame 120 onto solid surface 60 to support the orientation of ladder support device 110 when user leaves for a ladder 12 (therefore, support elements 114, 116 and flexible bar 112, due to their relative arrangement, provide a means for supporting orientation of the deployed ladder support device 110 without ladder 12 when unattended); lastly, user lowers ladder on support platform 118 in such way that predetermined rung 16 is lowered onto holders 190 until bottom ends of ladder 12 stand on work area 132 (FIG. 34). Placing ladder 12 on work area 132 and using ladder 12 may cause temporary deformation of flexible bar 112 but, at this point, orientation of ladder support device 110 is supported by ladder 12 leaned on a vertical surface with upper ends of rails 14. Flexible bar 112 will flex back as soon as ladder 12 is lifted off work area 132 regaining its function to support orientation of ladder support device 110 without the user when ladder is not positioned on work area 132.

Figure 54:
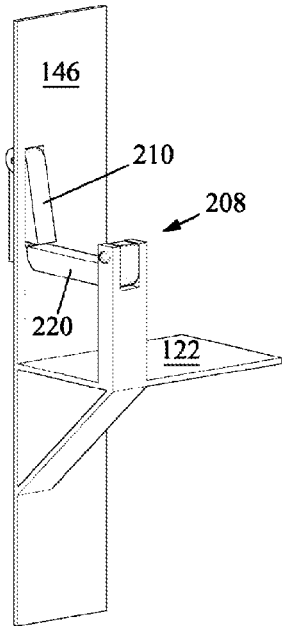
FIG. 54 is a perspective view of one of the locking holders depicted in FIG. 36 shown in the locked position.
Figure 55:
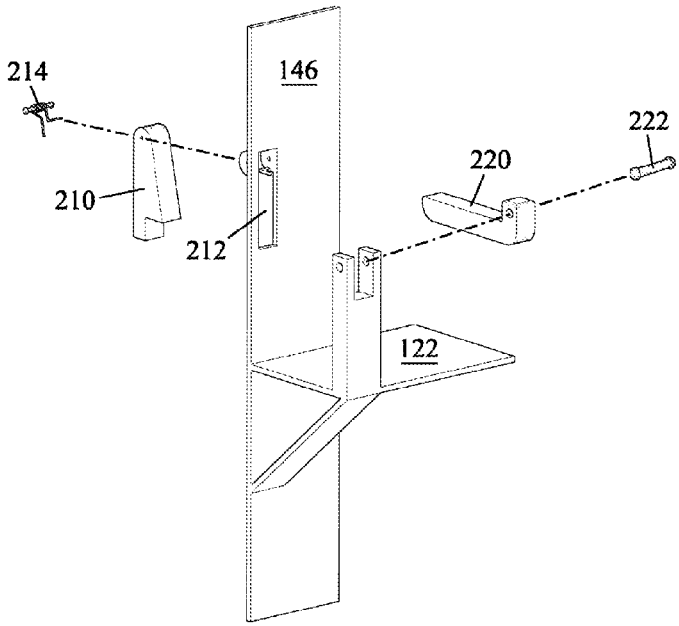
FIG. 55 is an exploded view of the locking holder depicted in FIG. 54.
Figure 56A:
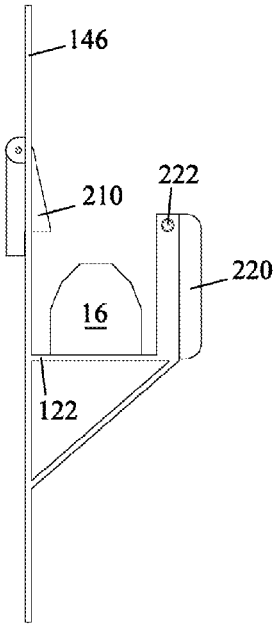
FIG. 56A is a side view of one of the locking holders depicted in FIG. 36 shown in the unlocked position.
Figure 56B:
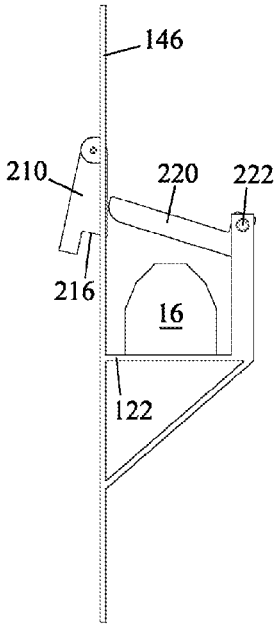
FIG. 56B is a side view of one of the locking holders depicted in FIG. 36 where the locking holder is about to be locked.
Figure 56C:
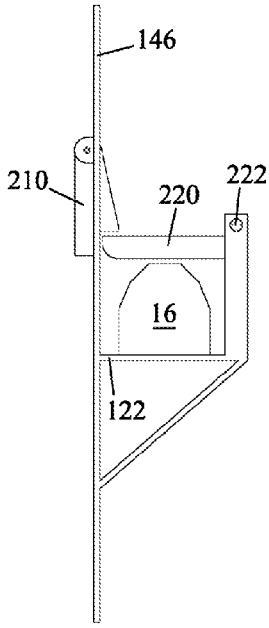
FIG. 56C is a side view of the locking holder depicted in FIG. 54.

FIG. 35 depicts a variation of the embodiment of ladder support device 110 where frame 120 comprises locking holders 208 for securing ladder 12 to ladder support device 110 when ladder 12 is positioned on work area 132. As seen in FIGS. 54-56C, locking holder 208 comprises a latch 210 biased out of a cutout 212 of U-shaped bar 146 by a torsion spring 214 and a pivoting member 220 which pivots about an axis 222. The pivoting member 220, when pivoted down toward the latch 210 (FIG. 56B), forces latch 210 to go inside of cutout 212 compressing torsion spring 214. When pivoting member 220 goes below threshold 216 of latch 210 (FIG. 56C), latch 210 goes out of cutout 212 under decompression force of torsion spring 214 locking ladder rung 16 by pivoting member 220 kept in position by threshold 216 (FIGS. 54 and 56C). At this point, the user is able to carry and to position ladder 12 and ladder support device 110 simultaneously.

This embodiment has advantages and disadvantages when compared to previous embodiments depicted in FIGS. 1A-23. For instance, previous embodiments provide only vertical support to ladders, where this embodiment provides not only vertical support with short support elements 114 and long support elements 116 but also sidewise support with long support elements 116.

As far as a disadvantage, if an angle between unfolded outer guides 138 is too big, then reducing height of work area 132 above solid surface 60 when long support elements 116 stand on solid surface 60 may not be possible by simply pushing frame 120 toward solid surface 60 when pressing release pedal 130. If such angle is chosen intentionally by a designer for increased stability sidewise, one of the solutions is to press pedal 130 when frame 120 is turned upside down to allow support elements 114 and 116 to fall down simultaneously under force of gravity inside of their respective guides 136 and 138 before moving to other location.

A user carries ladder support device 110 to a new location using handles 126 without ladder 12 or with ladder 12 when ladder 12 is locked to leveling device 110 with locking holders 208.

Figure 42:
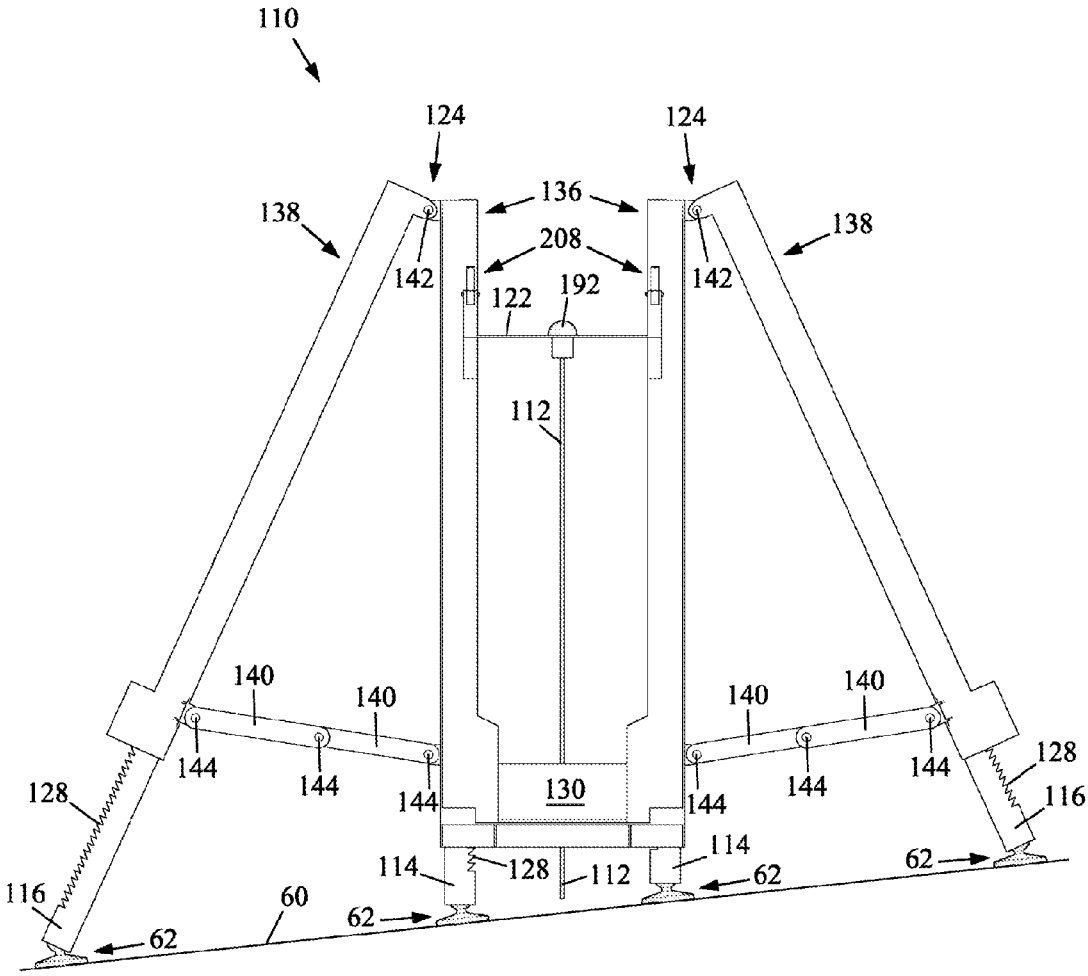
FIG. 42 is a front view of the ladder support device depicted in FIG. 36 leveled on an uneven surface.

Since each of support elements 114 and 116 is moving independently toward solid surface 60 when pedal 130 is pressed, the support platform 118 can be leveled above even or uneven solid surface 60 (FIGS. 42 and 59).

In order to improve stability of ladder support device 110 and preserve integrity of solid surface 60, each of support elements 114 and 116 comprises a non-detachable shoe 62 described in paragraph [0126].

FIGS. 60-69 depict a ladder support device 300 which is a modified embodiment of a ladder support device depicted in FIGS. 24-33 (although the embodiments depicted in FIGS. 1A-23 can be used as prototypes as well). The difference between the embodiments is that ladder support device 300 further comprises foldable members 304 and 306. Foldable members 304 and 306 are pivotal about top side of support platform 19 by hinges 308 and 310 correspondingly. Foldable member 304 comprises a rigidity rib 312, a cutout 302, and two holes 314. Foldable member 306 comprises a rigidity rib 313, cutout 302, and hole 314.

Figure 62:
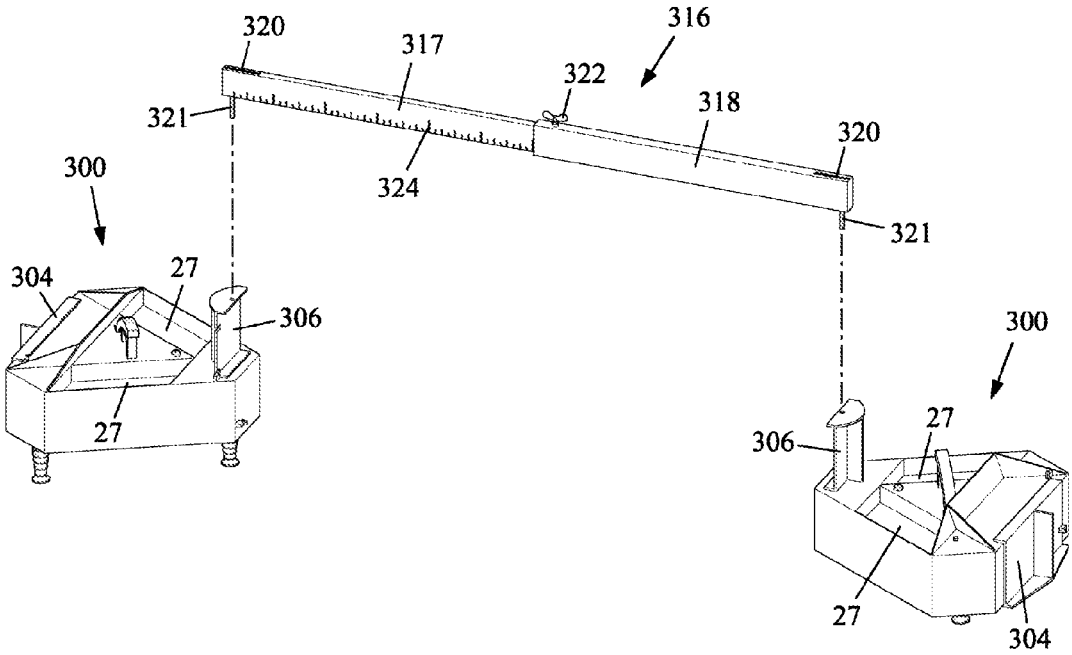
FIG. 62 is an exploded perspective view of two ladder support devices and a leveler.
Figure 63:
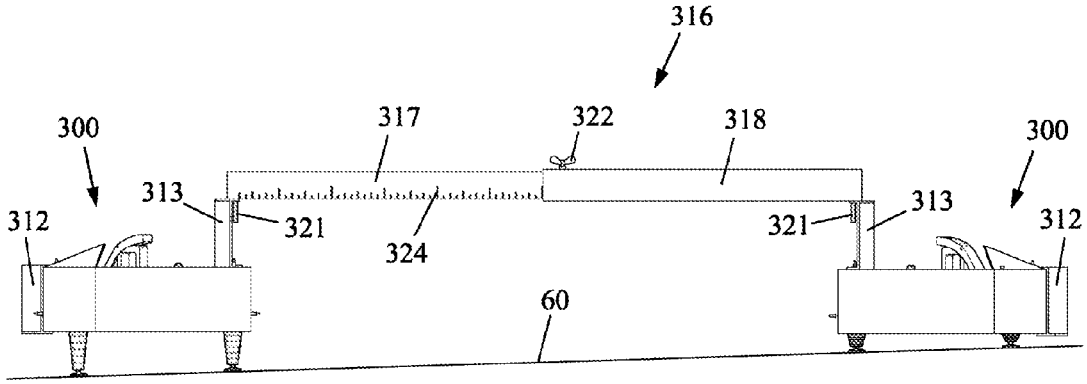
FIG. 63 is a front view of two ladder support devices standing on uneven ground with a leveler positioned on top.
Figure 64:
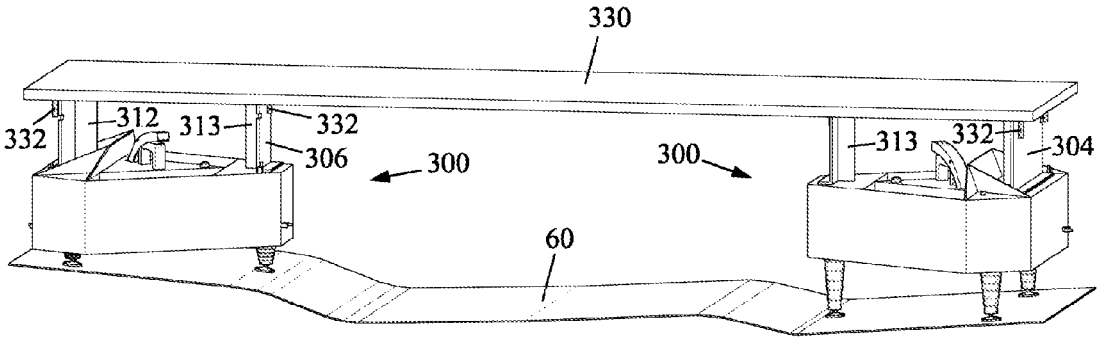
FIG. 64 is a perspective view of two ladder support devices standing on uneven ground with a scaffold positioned on top.
Figure 65:
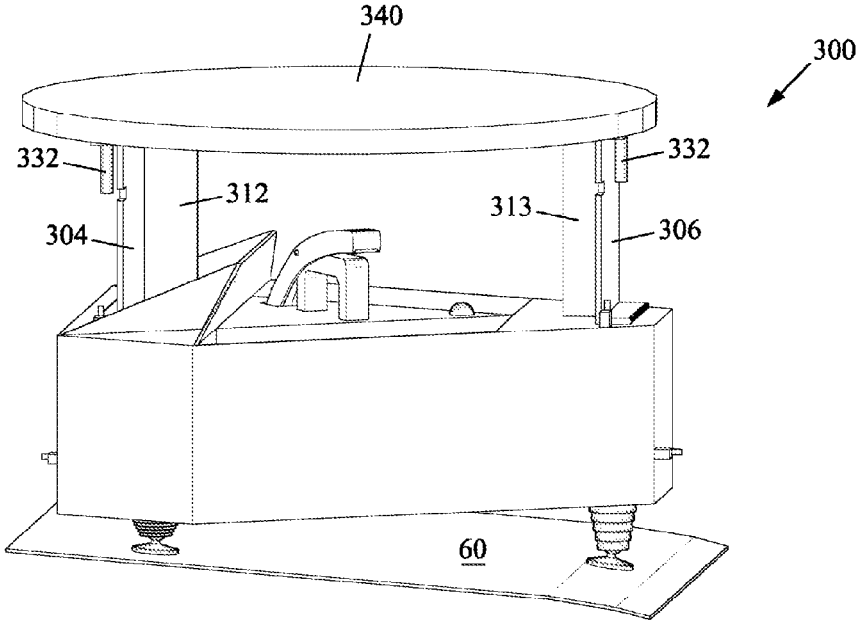
FIG. 65 is a perspective view of a ladder support device standing on uneven ground with a seat positioned on top.
Figure 66:
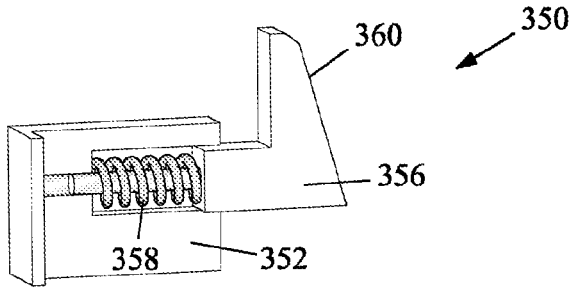
FIG. 66 is a perspective view of a latch shown without some of the body walls for clarity.
Figure 67:
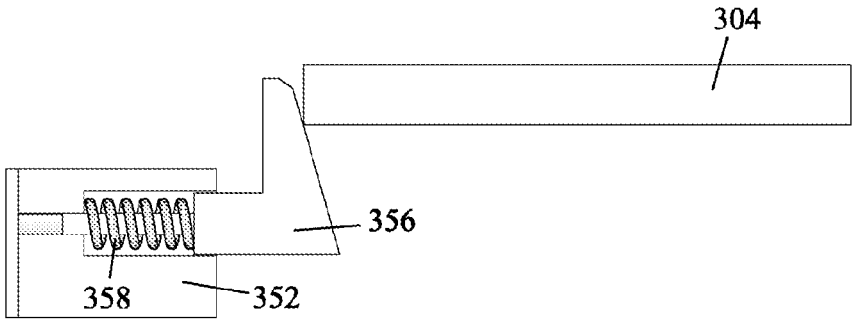
FIG. 67 is a front view of the latch depicted in FIG. 66 shown with a portion of a foldable member about to be pressed against the inclined side of the locking member.

FIG. 62 depicts a leveler 316 comprising inner telescopic part 317 and outer telescopic part 318. Inner telescopic part 317 goes inside of outer telescopic part 318. Each of telescopic parts 317 and 318 comprises an inclinometer 320 on the top side and a protruding member 321 on the bottom side. Inclinometers 320 and protruding members 321 are positioned at the far ends of leveler 316. Relative movement of telescopic parts 317 and 318 is prevented by tightening a wing screw 322. Inner telescopic part 317 also comprises measurement marks 324 indicating distance between protruding members 321 when aligned with an edge of outer telescopic part 318.

Figure 60:
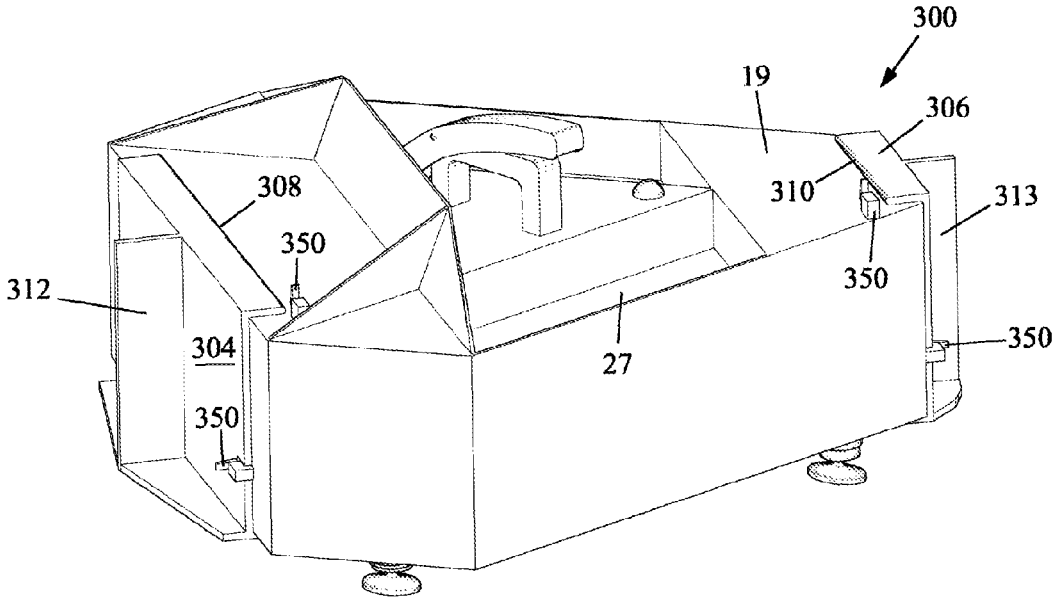
FIG. 60 is a perspective view of a modified embodiment of a ladder support device depicted in FIG. 24 shown with the foldable members folded.
Figure 61:
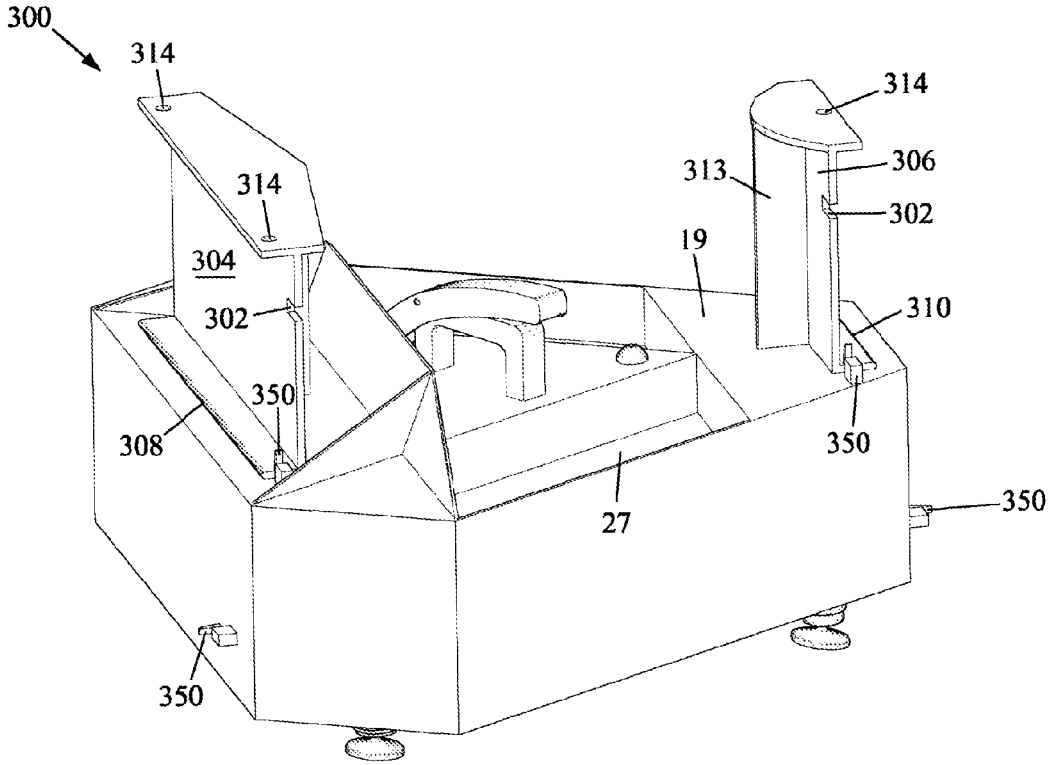
FIG. 61 is a perspective view of the ladder support device depicted in FIG. 60 shown with the foldable members unfolded.

When foldable members 304 and 306 of ladder support devices 300 are unfolded up about hinges 308 and 310 (FIG. 61), they get secured in the up positions by latches 350. Latches 350, located on the top of ladder support devices 300, secure foldable members 304 and 306 in unfolded (up) positions (FIG. 61); and latches 350, located on the sides of ladder support devices 300, secure foldable members 304 and 306 in folded (down) positions (FIG. 60).

Figure 68:
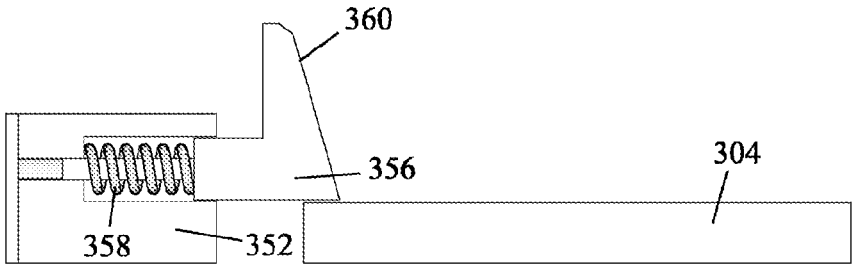
FIG. 68 is a front view of the latch and the foldable member depicted in FIG. 67 shown in a position where the foldable member is secured underneath the locking member.
Figure 69:
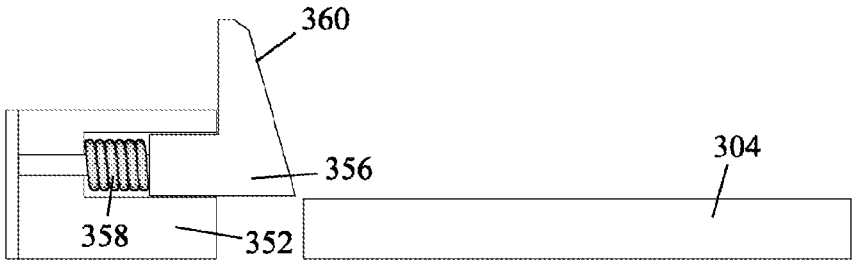
FIG. 69 is a front view of the latch and the foldable member depicted in FIG. 67 shown in a position where the locking member is moved out of the way for the foldable member to be released.

Latch 350 (best seen in FIG. 66) comprises a body 352 and a locking member 356 biased out of body 352 by a compression spring 358. Locking member 356 comprises an inclined side 360. Foldable member 304 or foldable member 306, when pressing against inclined side 360 of locking member 356 (FIG. 67), drives locking member 356 inside of body 352 compressing spring 358. When foldable member 304 or foldable member 306 passes completely over inclined side 360, the decompression force of spring 358 causes locking member 356 out of body 352 securing position of foldable member 304 or foldable member 306 (FIG. 68). In order to release foldable member 304 or foldable member 306, user moves locking member 356 out of the way by pressing on inclined side 360 (FIG. 69).

In use, when foldable members 304 and 306 of any two ladder support devices 300 are unfolded (FIGS. 62, and 63), user inserts protruding members 321 of leveler 316 into holes 314 of both ladder support devices 300; then, the user positions, for instance, foldable members 306 of both ladder support devices 300 at the same height using reading of inclinometers 320 and levels work areas 27 (as previously described herin). If a certain distance between any two holes 314 of two ladder support devices 300 is desired, user adjusts leveler 316 to the distance first by relaxing wing screw 322, adjusting relative position of telescopic parts 317 and 318 using measurement marks 324, and tightening back wing screw 322. The above described process can be repeated to bring a plurality of ladder support devices 300 to the same height regardless of ground profile where each pair of ladder support devices 300 is located at a predetermined distance from each other.

Such ability allows a user to position, for example, a step ladder, a table top, a scaffold 330 (FIG. 64) on two ladder support devices 300 or a temporary floor on more than two ladder support devices 300. In addition, a seat 340 (FIG. 65) can be positioned on top of a single ladder support devices 300 converting it to a chair. Objects positioned on top of ladder support devices 300 may be secured using holes 314. Scaffold 330 (FIG. 64) and seat 340 (FIG. 65), for instance, comprise bolts 332. Bolts 332 go inside of holes 314 and can be secured by wing nuts or other similar means known in the art.

In addition, the described embodiments which use ordinary cables and pulleys for controlling the latches, may use instead Bowden cables or any other such means known in the art.

Those who are skilled in the art will readily perceive how to modify the invention. Therefore, the appended claims are to be construed to cover all equivalent structures which fall within the scope and spirit of the invention.

What is claimed is:

1. A portable ladder support device for supporting a ladder positioned temporarily thereon, said ladder comprises two side rails connected by spaced rungs wherein the bottom ends of said two side rails are spaced apart within a range predetermined for said portable ladder support device, said portable ladder support device is capable of supporting said ladder by supporting the bottom ends of said two side rails, said portable ladder support device comprises at least one handling member, a plurality of support elements, and a frame comprising a fixating means, a release means, a plurality of guides for guiding movements of the support elements along predetermined trajectories, and a ladder support area for temporary positioning said ladder thereon by said bottom ends, each of said plurality of support elements is longitudinal, said fixating means is for preventing said movements simultaneously when engaged and for allowing said movements simultaneously when disengaged, said release means is for disengaging said fixating means when deployed by a user and for engaging said fixating means when disengaged by a user, said portable ladder support device is deployed when said ladder support area is capable of supporting said bottom ends, said ladder support area is capable of supporting said bottom ends when it is oriented at a predetermined angle and all of the support elements touch a solid surface and said release means is disengaged, said at least one handling member is for carrying said portable ladder support device and for orienting said ladder support area at said predetermined angle by at least one user regardless of positions of said plurality of support elements about said solid surface, said portable ladder support device also comprises a means for supporting orientation of the deployed portable ladder support device without said ladder when unattended, said portable ladder support device further comprises a predetermined number of restricting members for preventing movement of said bottom ends when said ladder is finally positioned on the deployed portable ladder support device, whereby the deployment of said portable ladder support device is achievable quickly on solid surfaces of various profiles since moving individually each of the support elements is unnecessary when a force is applied simultaneously to said plurality of support elements and said release means is deployed.

2. The portable ladder support device of claim 1, further comprising at least one inclinometer for indicating orientation of said ladder support area.

3. The portable ladder support device of claim 1, further comprising a predetermined number of lasers for indicating a location the top end of said ladder requiring a vertical support surface is about to be leaned on before said ladder is positioned on said portable ladder support device.

4. The portable ladder support device of claim 1 wherein said frame is flexibly connected to said at least one handling member, said frame is also pre-balanced about said at least one handling member, when without said ladder and none of said plurality of support elements is touching said solid surface, for maintaining orientation of said ladder support area at said predetermined angle due to force of gravity regardless of orientation of said at least one handling member while within predetermined orientation limits thereof.

5. The portable ladder support device of claim 1 wherein said portable ladder support device is foldable.

6. The portable ladder support device of claim 1 wherein the support elements are detachable.

7. The portable ladder support device of claim 1, further comprising a plurality of shoes for attaching to, and detaching from, the support elements by a user.

8. The portable ladder support device of claim 1, further comprising a plurality of expanding members for attaching to, and detaching from, the support elements by a user, whereby a user is able to deploy said portable ladder support device on said solid surface of various profiles, increase height of the deployed portable ladder support device, and improve stability of the deployed portable ladder support device by increasing its footprint.

9. The portable ladder support device of claim 8, further comprising a plurality of shoes for attaching to, and detaching from, the expanding members by a user.

10. The portable ladder support device of claim 1 wherein correlation of the trajectories is predetermined such that at least one user is able to move said frame up or down about said solid surface using only said at least one handling member when all of the support elements are touching said solid surface and said release means is deployed.

11. The portable ladder support device of claim 1 wherein the trajectories are parallel.

12. The portable ladder support device of claim 1 wherein said release means is further for indicating whether said fixating means is reliably engaged when said release means is disengaged.

13. The portable ladder support device of claim 1, further capable of supporting at least one object other than said ladder, each of said at least one object comprises at least one object limiting member wherein said frame further comprises at least one frame limiting member for limiting at least one freedom of movement of said at least one object about said portable ladder support device when engaged with said at least one object limiting member by a user.

14. The portable ladder support device of claim 13 wherein the object is a leveler configured for securing between at least two portable ladder support devices, said leveler comprises a predetermined number of inclinometers for indicating to a user the level difference between the connected portable ladder support devices when secured temporarily by the engaged limiting members there between, whereby a user is able to position the frames of any number of the portable ladder support devices at the same level regardless of profile of said solid surface for supporting the objects requiring leveled support regardless of object size.

* * * * *